US010410579B2

(12) United States Patent
Chaji

(10) Patent No.: US 10,410,579 B2
(45) Date of Patent: Sep. 10, 2019

(54) SYSTEMS AND METHODS OF HYBRID CALIBRATION OF BIAS CURRENT

(71) Applicant: Ignis Innovation Inc., Waterloo (CA)

(72) Inventor: Gholamreza Chaji, Waterloo (CA)

(73) Assignee: Ignis Innovation Inc., Waterloo, Ontario (CA)

( * ) Notice: Subject to any disclaimer, the term of this patent is extended or adjusted under 35 U.S.C. 154(b) by 252 days.

(21) Appl. No.: 15/215,036

(22) Filed: Jul. 20, 2016

(65) Prior Publication Data

US 2017/0025063 A1 Jan. 26, 2017

(30) Foreign Application Priority Data

Jul. 24, 2015 (CA) ..... 2898282

(51) Int. Cl.
*G09G 3/3233* (2016.01)

(52) U.S. Cl.
CPC ... *G09G 3/3233* (2013.01); *G09G 2300/0819* (2013.01); *G09G 2320/045* (2013.01); *G09G 2320/0693* (2013.01); *G09G 2330/10* (2013.01); *G09G 2330/12* (2013.01)

(58) Field of Classification Search
None
See application file for complete search history.

(56) References Cited

U.S. PATENT DOCUMENTS

| | | | |
|---|---|---|---|
| 3,506,851 | A | 4/1970 | Polkinghorn et al. |
| 3,750,987 | A | 8/1973 | Gobel |
| 3,774,055 | A | 11/1973 | Bapat et al. |
| 4,090,096 | A | 5/1978 | Nagami |
| 4,354,162 | A | 10/1982 | Wright |
| 4,758,831 | A | 7/1988 | Kasahara et al. |
| 4,963,860 | A | 10/1990 | Stewart |
| 4,975,691 | A | 12/1990 | Lee |
| 4,996,523 | A | 2/1991 | Bell et al. |
| 5,051,739 | A | 9/1991 | Hayashida et al. |
| 5,134,387 | A | 7/1992 | Smith et al. |
| 5,153,420 | A | 10/1992 | Hack et al. |

(Continued)

FOREIGN PATENT DOCUMENTS

| | | |
|---|---|---|
| AU | 729652 | 6/1997 |
| AU | 764896 | 12/2001 |
| CA | 1 294 034 | 1/1992 |
| CA | 2109951 | 11/1992 |
| CA | 2 249 592 | 7/1998 |

(Continued)

OTHER PUBLICATIONS

Ahnood et al.: "Effect of threshold voltage instability on field effect mobility in thin film transistors deduced from constant current measurements"; dated Aug. 2009 (3 pages).

(Continued)

*Primary Examiner* — Joseph R Haley
*Assistant Examiner* — Emily J Frank
(74) *Attorney, Agent, or Firm* — Stratford Managers Corporation

(57) ABSTRACT

What is disclosed are systems and methods of compensation of images produced by active matrix light emitting diode device (AMOLED) and other emissive displays. Anomalies in bias currents produced by current biasing circuits for driving current biased voltage programmed pixels are corrected through calibration and compensation while re-using existing data or other lines that can be controlled individually to perform said calibration and compensation.

16 Claims, 4 Drawing Sheets

(56) References Cited

U.S. PATENT DOCUMENTS 5,170,158 A 12/1992 Shinya
5,204,661 A 4/1993 Hack et al.
5,222,082 A 6/1993 Plus
5,266,515 A 11/1993 Robb et al.
5,278,542 A 1/1994 Smith et al.
5,408,267 A 4/1995 Main
5,498,880 A 3/1996 Lee et al.
5,572,444 A 11/1996 Lentz et al.
5,589,847 A 12/1996 Lewis
5,619,033 A 4/1997 Weisfield
5,648,276 A 7/1997 Hara et al.
5,670,973 A 9/1997 Bassetti et al.
5,684,365 A 11/1997 Tang et al.
5,686,935 A 11/1997 Weisbrod
5,691,783 A 11/1997 Numao et al.
5,701,505 A 12/1997 Yamashita et al.
5,712,653 A 1/1998 Katoh et al.
5,714,968 A 2/1998 Ikeda
5,744,824 A 4/1998 Kousai et al.
5,745,660 A 4/1998 Kolpatzik et al.
5,747,928 A 5/1998 Shanks et al.
5,748,160 A 5/1998 Shieh et al.
5,758,129 A 5/1998 Gray et al.
5,784,042 A 7/1998 Ono et al.
5,790,234 A 8/1998 Matsuyama
5,815,303 A 9/1998 Berlin
5,835,376 A 11/1998 Smith et al.
5,870,071 A 2/1999 Kawahata
5,874,803 A 2/1999 Garbuzov et al.
5,880,582 A 3/1999 Sawada
5,903,248 A 5/1999 Irwin
5,917,280 A 6/1999 Burrows et al.
5,923,794 A 7/1999 McGrath et al.
5,949,398 A 9/1999 Kim
5,952,789 A 9/1999 Stewart et al.
5,990,629 A 11/1999 Yamada et al.
6,023,259 A 2/2000 Howard et al.
6,069,365 A 5/2000 Chow et al.
6,081,131 A 6/2000 Ishii
6,091,203 A 7/2000 Kawashima et al.
6,097,360 A 8/2000 Holloman
6,100,868 A 8/2000 Lee et al.
6,144,222 A 11/2000 Ho
6,157,583 A 12/2000 Starnes et al.
6,166,489 A 12/2000 Thompson et al.
6,177,915 B1 1/2001 Beeteson et al.
6,225,846 B1 5/2001 Wada et al.
6,229,506 B1 5/2001 Dawson et al.
6,229,508 B1 5/2001 Kane
6,232,939 B1 5/2001 Saito et al.
6,246,180 B1 6/2001 Nishigaki
6,252,248 B1 6/2001 Sano et al.
6,259,424 B1 7/2001 Kurogane
6,268,841 B1 7/2001 Cairns et al.
6,274,887 B1 8/2001 Yamazaki et al.
6,288,696 B1 9/2001 Holloman
6,300,928 B1 10/2001 Kim
6,303,963 B1 10/2001 Ohtani et al.
6,306,694 B1 10/2001 Yamazaki et al.
6,307,322 B1 10/2001 Dawson et al.
6,310,962 B1 10/2001 Chung et al.
6,316,786 B1 11/2001 Mueller et al.
6,320,325 B1 11/2001 Cok et al.
6,323,631 B1 11/2001 Juang
6,323,832 B1 11/2001 Nishizawa et al.
6,333,729 B1 12/2001 Ha
6,345,085 B1 2/2002 Yeo et al.
6,348,835 B1 2/2002 Sato et al.
6,365,917 B1 4/2002 Yamazaki
6,373,453 B1 4/2002 Yudasaka
6,384,427 B1 5/2002 Yamazaki et al.
6,384,804 B1 5/2002 Dodabalapur et al.
6,388,653 B1 5/2002 Goto et al.
6,392,617 B1 5/2002 Gleason
6,396,469 B1 5/2002 Miwa et al.
6,399,988 B1 6/2002 Yamazaki
6,414,661 B1 7/2002 Shen et al.
6,417,825 B1 7/2002 Stewart et al.
6,420,758 B1 7/2002 Nakajima
6,420,834 B2 7/2002 Yamazaki et al.
6,420,988 B1 7/2002 Azami et al.
6,430,496 B1 8/2002 Smith et al.
6,433,488 B1 8/2002 Bu
6,445,376 B2 9/2002 Parrish
6,468,638 B2 10/2002 Jacobsen et al.
6,473,065 B1 10/2002 Fan
6,475,845 B2 11/2002 Kimura
6,489,952 B1 12/2002 Tanaka et al.
6,501,098 B2 12/2002 Yamazaki
6,501,466 B1 12/2002 Yamagashi et al.
6,512,271 B1 1/2003 Yamazaki et al.
6,518,594 B1 2/2003 Nakajima et al.
6,522,315 B2 2/2003 Ozawa et al.
6,524,895 B2 2/2003 Yamazaki et al.
6,531,713 B1 3/2003 Yamazaki
6,535,185 B2 3/2003 Kim et al.
6,542,138 B1 4/2003 Shannon et al.
6,559,594 B2 5/2003 Fukunaga et al.
6,559,839 B1 5/2003 Ueno et al.
6,573,195 B1 6/2003 Yamazaki et al.
6,573,584 B1 6/2003 Nagakari et al.
6,576,926 B1 6/2003 Yamazaki et al.
6,577,302 B2 6/2003 Hunter
6,580,408 B1 6/2003 Bae et al.
6,580,657 B2 6/2003 Sanford et al.
6,583,398 B2 6/2003 Harkin
6,583,775 B1 6/2003 Sekiya et al.
6,583,776 B2 6/2003 Yamazaki et al.
6,587,086 B1 7/2003 Koyama
6,593,691 B2 7/2003 Nishi et al.
6,594,606 B2 7/2003 Everitt
6,597,203 B2 7/2003 Forbes
6,611,108 B2 8/2003 Kimura
6,617,644 B1 9/2003 Yamazaki et al.
6,618,030 B2 9/2003 Kane et al.
6,639,244 B1 10/2003 Yamazaki et al.
6,641,933 B1 11/2003 Yamazaki et al.
6,661,180 B2 12/2003 Koyama
6,661,397 B2 12/2003 Mikami et al.
6,670,637 B2 12/2003 Yamazaki et al.
6,677,713 B1 1/2004 Sung
6,680,577 B1 1/2004 Inukai et al.
6,680,580 B1 1/2004 Sung
6,686,699 B2 2/2004 Yumoto
6,687,266 B1 2/2004 Ma et al.
6,690,000 B1 2/2004 Muramatsu et al.
6,690,344 B1 2/2004 Takeuchi et al.
6,693,388 B2 2/2004 Oomura
6,693,610 B2 2/2004 Shannon et al.
6,694,248 B2 2/2004 Smith et al.
6,697,057 B2 2/2004 Koyama et al.
6,720,942 B2 4/2004 Lee et al.
6,724,151 B2 4/2004 Yoo
6,734,636 B2 5/2004 Sanford et al.
6,738,034 B2 5/2004 Kaneko et al.
6,738,035 B1 5/2004 Fan
6,753,655 B2 6/2004 Shih et al.
6,753,834 B2 6/2004 Mikami et al.
6,756,741 B2 6/2004 Li
6,756,958 B2 6/2004 Furuhashi et al.
6,771,028 B1 8/2004 Winters
6,777,712 B2 8/2004 Sanford et al.
6,777,888 B2 8/2004 Kondo
6,780,687 B2 8/2004 Nakajima et al.
6,781,567 B2 8/2004 Kimura
6,788,231 B1 9/2004 Hsueh
6,806,638 B2 10/2004 Lih et al.
6,806,857 B2 10/2004 Sempel et al.
6,809,706 B2 10/2004 Shimoda
6,828,950 B2 12/2004 Koyama
6,858,991 B2 2/2005 Miyazawa
6,859,193 B1 2/2005 Yumoto
6,861,670 B1 3/2005 Ohtani et al.
6,873,117 B2 3/2005 Ishizuka

(56) References Cited

U.S. PATENT DOCUMENTS 6,873,320 B2 3/2005 Nakamura
6,876,346 B2 4/2005 Anzai et al.
6,878,968 B1 4/2005 Ohnuma
6,900,485 B2 5/2005 Lee
6,903,734 B2 6/2005 Eu
6,909,114 B1 6/2005 Yamazaki
6,909,419 B2 6/2005 Zavracky et al.
6,911,960 B1 6/2005 Yokoyama
6,911,964 B2 6/2005 Lee et al.
6,914,448 B2 7/2005 Jinno
6,919,871 B2 7/2005 Kwon
6,924,602 B2 8/2005 Komiya
6,937,215 B2 8/2005 Lo
6,937,220 B2 8/2005 Kitaura et al.
6,940,214 B1 9/2005 Komiya et al.
6,943,500 B2 9/2005 LeChevalier
6,954,194 B2 10/2005 Matsumoto et al.
6,956,547 B2 10/2005 Bae et al.
6,970,149 B2 11/2005 Chung et al.
6,975,142 B2 12/2005 Azami et al.
6,975,332 B2 12/2005 Arnold et al.
6,995,510 B2 2/2006 Murakami et al.
6,995,519 B2 2/2006 Arnold et al.
7,022,556 B1 4/2006 Adachi
7,023,408 B2 4/2006 Chen et al.
7,027,015 B2 4/2006 Booth, Jr. et al.
7,034,793 B2 4/2006 Sekiya et al.
7,038,392 B2 5/2006 Libsch et al.
7,057,588 B2 6/2006 Asano et al.
7,061,451 B2 6/2006 Kimura
7,071,932 B2 7/2006 Libsch et al.
7,088,051 B1 8/2006 Cok
7,106,285 B2 9/2006 Naugler
7,112,820 B2 9/2006 Chang et al.
7,113,864 B2 9/2006 Smith et al.
7,116,058 B2 10/2006 Lo et al.
7,122,835 B1 10/2006 Ikeda et al.
7,129,914 B2 10/2006 Knapp et al.
7,129,917 B2 10/2006 Yamazaki et al.
7,141,821 B1 11/2006 Yamazaki et al.
7,161,566 B2 1/2007 Cok et al.
7,164,417 B2 1/2007 Cok
7,193,589 B2 3/2007 Yoshida et al.
7,199,516 B2 4/2007 Seo et al.
7,220,997 B2 5/2007 Nakata
7,224,332 B2 5/2007 Cok
7,235,810 B1 6/2007 Yamazaki et al.
7,245,277 B2 7/2007 Ishizuka
7,248,236 B2 7/2007 Nathan et al.
7,259,737 B2 8/2007 Ono et al.
7,262,753 B2 8/2007 Tanghe et al.
7,264,979 B2 9/2007 Yamagata et al.
7,274,345 B2 9/2007 Imamura et al.
7,274,363 B2 9/2007 Ishizuka et al.
7,279,711 B1 10/2007 Yamazaki et al.
7,304,621 B2 12/2007 Oomori et al.
7,310,092 B2 12/2007 Imamura
7,315,295 B2 1/2008 Kimura
7,317,429 B2 1/2008 Shirasaki et al.
7,317,434 B2 1/2008 Lan et al.
7,319,465 B2 1/2008 Mikami et al.
7,321,348 B2 1/2008 Cok et al.
7,327,357 B2 2/2008 Jeong
7,333,077 B2 2/2008 Koyama et al.
7,339,636 B2 3/2008 Voloschenko et al.
7,343,243 B2 3/2008 Smith et al.
7,355,574 B1 4/2008 Leon et al.
7,358,941 B2 4/2008 Ono et al.
7,402,467 B1 7/2008 Kadono et al.
7,414,600 B2 8/2008 Nathan et al.
7,432,885 B2 10/2008 Asano et al.
7,466,166 B2 12/2008 Date et al.
7,474,285 B2 1/2009 Kimura
7,485,478 B2 2/2009 Yamagata et al.
7,495,501 B2 2/2009 Iwabuchi et al.
7,502,000 B2 3/2009 Yuki et al.
7,515,124 B2 4/2009 Yaguma et al.
7,535,449 B2 5/2009 Miyazawa
7,554,512 B2 6/2009 Steer
7,569,849 B2 8/2009 Nathan et al.
7,595,776 B2 9/2009 Hashimoto et al.
7,604,718 B2 10/2009 Zhang et al.
7,609,239 B2 10/2009 Chang
7,612,745 B2 11/2009 Yumoto et al.
7,619,594 B2 11/2009 Hu
7,619,597 B2 11/2009 Nathan et al.
7,639,211 B2 12/2009 Miyazawa
7,683,899 B2 3/2010 Hirakata et al.
7,688,289 B2 3/2010 Abe et al.
7,697,052 B1 4/2010 Yamazaki et al.
7,760,162 B2 7/2010 Miyazawa
7,808,008 B2 10/2010 Miyake
7,825,419 B2 11/2010 Yamagata et al.
7,859,492 B2 12/2010 Kohno
7,859,520 B2 12/2010 Kimura
7,868,859 B2 1/2011 Tomida et al.
7,876,294 B2 1/2011 Sasaki et al.
7,889,159 B2 2/2011 Nathan et al.
7,903,127 B2 3/2011 Kwon
7,920,116 B2 4/2011 Woo et al.
7,944,414 B2 5/2011 Shirasaki et al.
7,948,170 B2 5/2011 Striakhilev et al.
7,969,390 B2 6/2011 Yoshida
7,978,170 B2 7/2011 Park et al.
7,989,392 B2 8/2011 Crockett et al.
7,995,008 B2 8/2011 Miwa
7,995,010 B2 8/2011 Yamazaki et al.
8,044,893 B2 10/2011 Nathan et al.
8,063,852 B2 11/2011 Kwak et al.
8,102,343 B2 1/2012 Yatabe
8,115,707 B2 2/2012 Nathan et al.
8,144,081 B2 3/2012 Miyazawa
8,159,007 B2 4/2012 Bama et al.
8,242,979 B2 8/2012 Anzai et al.
8,253,665 B2 * 8/2012 Nathan ..... G09G 3/3233 315/169.1
8,283,967 B2 10/2012 Chaji et al.
8,319,712 B2 11/2012 Nathan et al.
8,378,362 B2 2/2013 Heo et al.
8,493,295 B2 7/2013 Yamazaki et al.
8,497,525 B2 7/2013 Yamagata et al.
8,564,513 B2 10/2013 Nathan et al.
8,872,739 B2 10/2014 Kimura
2001/0002703 A1 6/2001 Koyama
2001/0004190 A1 6/2001 Nishi et al.
2001/0009283 A1 7/2001 Arao et al.
2001/0013806 A1 8/2001 Notani
2001/0015653 A1 8/2001 De Jong et al.
2001/0020926 A1 9/2001 Kujik
2001/0024186 A1 9/2001 Kane et al.
2001/0026127 A1 10/2001 Yoneda et al.
2001/0026179 A1 10/2001 Saeki
2001/0026257 A1 10/2001 Kimura
2001/0030323 A1 10/2001 Ikeda
2001/0033199 A1 10/2001 Aoki
2001/0035863 A1 11/2001 Kimura
2001/0038098 A1 11/2001 Yamazaki et al.
2001/0040541 A1 11/2001 Yoneda et al.
2001/0043173 A1 11/2001 Troutman
2001/0045929 A1 11/2001 Prache et al.
2001/0052606 A1 12/2001 Sempel et al.
2001/0052898 A1 12/2001 Osame et al.
2001/0052940 A1 12/2001 Hagihara et al.
2002/0000576 A1 1/2002 Inukai
2002/0011796 A1 1/2002 Koyama
2002/0011799 A1 1/2002 Kimura
2002/0011981 A1 1/2002 Kujik
2002/0012057 A1 1/2002 Kimura
2002/0015031 A1 2/2002 Fujita et al.
2002/0015032 A1 2/2002 Koyama et al.
2002/0030190 A1 3/2002 Ohtani et al.
2002/0030528 A1 3/2002 Matsumoto et al.
2002/0030647 A1 3/2002 Hack et al.
2002/0036463 A1 3/2002 Yoneda et al.

(56) References Cited

U.S. PATENT DOCUMENTS

2002/0047565 A1 4/2002 Nara et al.
2002/0047852 A1 4/2002 Inukai et al.
2002/0048829 A1 4/2002 Yamazaki et al.
2002/0050795 A1 5/2002 Imura
2002/0052086 A1 5/2002 Maeda
2002/0053401 A1 5/2002 Ishikawa et al.
2002/0070909 A1 6/2002 Asano et al.
2002/0080108 A1 6/2002 Wang
2002/0084463 A1 7/2002 Sanford et al.
2002/0101172 A1 8/2002 Bu
2002/0101433 A1 8/2002 McKnight
2002/0113248 A1 8/2002 Yaniagata et al.
2002/0117722 A1 8/2002 Osada et al.
2002/0122308 A1 9/2002 Ikeda
2002/0130686 A1 9/2002 Forbes
2002/0140712 A1 10/2002 Ouchi et al.
2002/0154084 A1 10/2002 Tanaka et al.
2002/0158587 A1 10/2002 Komiya
2002/0158666 A1 10/2002 Azami et al.
2002/0158823 A1 10/2002 Zavracky et al.
2002/0163314 A1 11/2002 Yamazaki et al.
2002/0167471 A1 11/2002 Everitt
2002/0171613 A1 11/2002 Goto et al.
2002/0180369 A1 12/2002 Koyama
2002/0180721 A1 12/2002 Kimura et al.
2002/0181275 A1 12/2002 Yamazaki
2002/0186214 A1 12/2002 Siwinski
2002/0190332 A1 12/2002 Lee et al.
2002/0190924 A1 12/2002 Asano et al.
2002/0190971 A1 12/2002 Nakamura et al.
2002/0195967 A1 12/2002 Kim et al.
2002/0195968 A1 12/2002 Sanford et al.
2002/0196213 A1 12/2002 Akimoto et al.
2003/0001828 A1 1/2003 Asano
2003/0001858 A1 1/2003 Jack
2003/0016190 A1 1/2003 Kondo
2003/0020413 A1 1/2003 Oomura
2003/0030603 A1 2/2003 Shimoda
2003/0062524 A1 4/2003 Kimura
2003/0062844 A1 4/2003 Miyazawa
2003/0063081 A1 4/2003 Kimura et al.
2003/0071804 A1 4/2003 Yamazaki et al.
2003/0071821 A1 4/2003 Sundahl
2003/0076048 A1 4/2003 Rutherford
2003/0090445 A1 5/2003 Chen et al.
2003/0090447 A1 5/2003 Kimura
2003/0090481 A1 5/2003 Kimura
2003/0095087 A1 5/2003 Libsch
2003/0098829 A1 5/2003 Chen et al.
2003/0107560 A1 6/2003 Yumoto et al.
2003/0107561 A1 6/2003 Uchino et al.
2003/0111966 A1 6/2003 Mikami et al.
2003/0112205 A1 6/2003 Yamada
2003/0112208 A1 6/2003 Okabe et al.
2003/0117348 A1 6/2003 Knapp et al.
2003/0122474 A1 7/2003 Lee
2003/0122745 A1 7/2003 Miyazawa
2003/0122747 A1 7/2003 Shannon et al.
2003/0128199 A1 7/2003 Kimura
2003/0140958 A1 7/2003 Yang et al.
2003/0151569 A1 8/2003 Lee et al.
2003/0156104 A1 8/2003 Morita
2003/0169219 A1 9/2003 LeChevalier
2003/0169241 A1 9/2003 LeChevalier
2003/0169247 A1 9/2003 Kawabe et al.
2003/0174152 A1 9/2003 Noguchi
2003/0178617 A1 9/2003 Appenzeller et al.
2003/0179626 A1 9/2003 Sanford et al.
2003/0185438 A1 10/2003 Osawa et al.
2003/0189535 A1 10/2003 Matsumoto et al.
2003/0197663 A1 10/2003 Lee et al.
2003/0206060 A1 11/2003 Suzuki
2003/0214465 A1 11/2003 Kimura
2003/0227262 A1 12/2003 Kwon
2003/0230141 A1 12/2003 Gilmour et al.
2003/0230980 A1 12/2003 Forrest et al.
2004/0004589 A1 1/2004 Shih
2004/0027063 A1 2/2004 Nishikawa
2004/0032382 A1 2/2004 Cok et al.
2004/0041750 A1 3/2004 Abe
2004/0056604 A1 3/2004 Shih et al.
2004/0066357 A1 4/2004 Kawasaki
2004/0070557 A1 4/2004 Asano et al.
2004/0070558 A1 4/2004 Cok
2004/0080262 A1 4/2004 Park et al.
2004/0080470 A1 4/2004 Yamazaki et al.
2004/0090186 A1 5/2004 Yoshida et al.
2004/0090400 A1 5/2004 Yoo
2004/0095338 A1 5/2004 Takashi
2004/0108518 A1 6/2004 Jo
2004/0113903 A1 6/2004 Mikami et al.
2004/0129933 A1 7/2004 Nathan et al.
2004/0130516 A1 7/2004 Nathan et al.
2004/0135749 A1 7/2004 Kondakov et al.
2004/0145547 A1 7/2004 Oh
2004/0150592 A1 8/2004 Mizukoshi et al.
2004/0150594 A1 8/2004 Koyama et al.
2004/0150595 A1 8/2004 Kasai
2004/0155841 A1 8/2004 Kasai
2004/0171619 A1 9/2004 Barkoczy et al.
2004/0174347 A1 9/2004 Sun et al.
2004/0174349 A1 9/2004 Libsch
2004/0174354 A1 9/2004 Ono
2004/0183759 A1 9/2004 Stevenson et al.
2004/0189627 A1 9/2004 Shirasaki et al.
2004/0196275 A1 10/2004 Hattori
2004/0201554 A1 10/2004 Satoh
2004/0207615 A1 10/2004 Yumoto
2004/0227697 A1 11/2004 Mori
2004/0233125 A1 11/2004 Tanghe et al.
2004/0239596 A1 12/2004 Ono et al.
2004/0239696 A1 12/2004 Okabe
2004/0251844 A1 12/2004 Hashido et al.
2004/0252089 A1 12/2004 Ono et al.
2004/0256617 A1 12/2004 Yamada et al.
2004/0257353 A1 12/2004 Imamura et al.
2004/0257355 A1 12/2004 Naugler
2004/0263437 A1 12/2004 Hattori
2005/0007357 A1 1/2005 Yamashita et al.
2005/0030267 A1 2/2005 Tanghe et al.
2005/0035709 A1 2/2005 Furuie et al.
2005/0041002 A1* 2/2005 Takahara ..... G09G 3/3241 345/76
2005/0052379 A1 3/2005 Waterman
2005/0057459 A1 3/2005 Miyazawa
2005/0067970 A1 3/2005 Libsch et al.
2005/0067971 A1 3/2005 Kane
2005/0068270 A1 3/2005 Awakura
2005/0083270 A1 4/2005 Miyazawa
2005/0088085 A1 4/2005 Nishikawa et al.
2005/0088103 A1 4/2005 Kageyama et al.
2005/0110420 A1 5/2005 Arnold et al.
2005/0110727 A1 5/2005 Shin
2005/0117096 A1 6/2005 Voloschenko et al.
2005/0123193 A1 6/2005 Lamberg et al.
2005/0140598 A1 6/2005 Kim et al.
2005/0140600 A1 6/2005 Kim et al.
2005/0140610 A1 6/2005 Smith et al.
2005/0145891 A1 7/2005 Abe
2005/0156831 A1 7/2005 Yamazaki et al.
2005/0168416 A1 8/2005 Hashimoto et al.
2005/0206590 A1 9/2005 Sasaki et al.
2005/0212787 A1 9/2005 Noguchi et al.
2005/0219188 A1 10/2005 Kawabe et al.
2005/0225686 A1 10/2005 Brummack et al.
2005/0243037 A1 11/2005 Eom et al.
2005/0248515 A1 11/2005 Naugler et al.
2005/0258867 A1 11/2005 Miyazawa
2005/0260777 A1 11/2005 Brabec et al.
2005/0269959 A1 12/2005 Uchino et al.
2005/0269960 A1 12/2005 Ono et al.
2005/0285822 A1 12/2005 Reddy et al.
2005/0285825 A1 12/2005 Eom et al.
2006/0007072 A1 1/2006 Choi et al.

(56) References Cited

U.S. PATENT DOCUMENTS

2006/0012310 A1 1/2006 Chen et al.
2006/0012311 A1 1/2006 Ogawa
2006/0022305 A1 2/2006 Yamashita
2006/0027807 A1 2/2006 Nathan et al.
2006/0030084 A1 2/2006 Young
2006/0038750 A1 2/2006 Inoue et al.
2006/0038758 A1 2/2006 Routley et al.
2006/0038762 A1 2/2006 Chou
2006/0044227 A1 3/2006 Hadcock
2006/0066527 A1 3/2006 Chou
2006/0066533 A1 3/2006 Sato et al.
2006/0077077 A1 4/2006 Kwon
2006/0077134 A1 4/2006 Hector
2006/0077194 A1 4/2006 Jeong
2006/0092185 A1 5/2006 Jo et al.
2006/0114196 A1 6/2006 Shin
2006/0125408 A1 6/2006 Nathan et al.
2006/0125740 A1 6/2006 Shirasaki et al.
2006/0139253 A1 6/2006 Choi et al.
2006/0145964 A1 7/2006 Park et al.
2006/0158402 A1 7/2006 Nathan
2006/0191178 A1 8/2006 Sempel et al.
2006/0208971 A1 9/2006 Deane
2006/0209012 A1 9/2006 Hagood, IV
2006/0214888 A1 9/2006 Schneider et al.
2006/0221009 A1 10/2006 Miwa
2006/0227082 A1 10/2006 Ogata et al.
2006/0232522 A1 10/2006 Roy et al.
2006/0244391 A1 11/2006 Shishido et al.
2006/0244697 A1 11/2006 Lee et al.
2006/0261841 A1 11/2006 Fish
2006/0264143 A1 11/2006 Lee et al.
2006/0273997 A1 12/2006 Nathan et al.
2006/0279478 A1 12/2006 Ikegami
2006/0284801 A1 12/2006 Yoon et al.
2006/0290614 A1 12/2006 Nathan et al.
2007/0001937 A1 1/2007 Park et al.
2007/0001939 A1 1/2007 Hashimoto et al.
2007/0001945 A1 1/2007 Yoshida et al.
2007/0008251 A1 1/2007 Kohno et al.
2007/0008268 A1 1/2007 Park et al.
2007/0008297 A1 1/2007 Bassetti
2007/0035707 A1 2/2007 Margulis
2007/0040773 A1 2/2007 Lee et al.
2007/0040782 A1 2/2007 Woo et al.
2007/0046195 A1 3/2007 Chin et al.
2007/0057873 A1 3/2007 Uchino et al.
2007/0057874 A1 3/2007 Le Roy et al.
2007/0063932 A1* 3/2007 Nathan ..... G09G 3/3233 345/76
2007/0069998 A1 3/2007 Naugler et al.
2007/0075957 A1 4/2007 Chen
2007/0080905 A1 4/2007 Takahara
2007/0080906 A1 4/2007 Tanabe
2007/0080908 A1 4/2007 Nathan et al.
2007/0080918 A1 4/2007 Kawachi et al.
2007/0085801 A1 4/2007 Park et al.
2007/0103419 A1 5/2007 Uchino et al.
2007/0109232 A1 5/2007 Yamamoto et al.
2007/0128583 A1 6/2007 Miyazawa
2007/0164941 A1 7/2007 Park et al.
2007/0182671 A1 8/2007 Nathan et al.
2007/0236430 A1 10/2007 Fish
2007/0236440 A1 10/2007 Wacyk et al.
2007/0241999 A1 10/2007 Lin
2007/0242008 A1 10/2007 Cummings
2007/0273294 A1 11/2007 Nagayama
2007/0285359 A1 12/2007 Ono
2007/0296672 A1 12/2007 Kim et al.
2008/0001544 A1 1/2008 Murakami et al.
2008/0042948 A1 2/2008 Yamashita et al.
2008/0043044 A1 2/2008 Woo et al.
2008/0048951 A1 2/2008 Naugler et al.
2008/0055134 A1 3/2008 Li et al.
2008/0055209 A1 3/2008 Cok
2008/0062106 A1 3/2008 Tseng
2008/0074413 A1 3/2008 Ogura
2008/0088549 A1 4/2008 Nathan et al.
2008/0094426 A1 4/2008 Kimpe
2008/0111766 A1 5/2008 Uchino et al.
2008/0122803 A1 5/2008 Izadi et al.
2008/0122819 A1 5/2008 Cho et al.
2008/0074360 A1 6/2008 Lu et al.
2008/0129906 A1 6/2008 Lin et al.
2008/0198103 A1 8/2008 Toyomura et al.
2008/0219232 A1 9/2008 Heubel et al.
2008/0228562 A1 9/2008 Smith et al.
2008/0230118 A1 9/2008 Nakatani et al.
2008/0231625 A1 9/2008 Minami et al.
2008/0231641 A1 9/2008 Miyashita
2008/0265786 A1 10/2008 Koyama
2008/0290805 A1 11/2008 Yamada et al.
2009/0009459 A1 1/2009 Miyashita
2009/0015532 A1 1/2009 Katayama et al.
2009/0032807 A1 2/2009 Shinohara et al.
2009/0051283 A1 2/2009 Cok et al.
2009/0058789 A1 3/2009 Hung et al.
2009/0121988 A1 5/2009 Amo et al.
2009/0146926 A1 6/2009 Sung et al.
2009/0153448 A1 6/2009 Tomida et al.
2009/0153459 A9 6/2009 Han et al.
2009/0160743 A1 6/2009 Tomida et al.
2009/0162961 A1 6/2009 Deane
2009/0174628 A1 7/2009 Wang et al.
2009/0201230 A1 8/2009 Smith
2009/0201281 A1 8/2009 Routley et al.
2009/0206764 A1 8/2009 Schemmann et al.
2009/0213046 A1 8/2009 Nam
2009/0225011 A1 9/2009 Choi
2009/0244046 A1 10/2009 Seto
2009/0251486 A1 10/2009 Sakakibara et al.
2009/0278777 A1 11/2009 Wang et al.
2009/0289964 A1 11/2009 Miyachi
2009/0295423 A1 12/2009 Levey
2010/0026725 A1 2/2010 Smith
2010/0033469 A1 2/2010 Nathan
2010/0039451 A1 2/2010 Jung
2010/0039453 A1 2/2010 Nathan et al.
2010/0045646 A1 2/2010 Kishi
2010/0052524 A1 3/2010 Kinoshita
2010/0078230 A1 4/2010 Rosenblatt et al.
2010/0079419 A1 4/2010 Shibusawa
2010/0079711 A1 4/2010 Tanaka
2010/0097335 A1 4/2010 Jung et al.
2010/0133994 A1 6/2010 Song et al.
2010/0134456 A1 6/2010 Oyamada
2010/0134475 A1 6/2010 Ogura
2010/0140600 A1 6/2010 Clough et al.
2010/0141564 A1 6/2010 Choi et al.
2010/0156279 A1 6/2010 Tamura et al.
2010/0207920 A1 8/2010 Chaji et al.
2010/0225634 A1 9/2010 Levey et al.
2010/0237374 A1 9/2010 Chu et al.
2010/0251295 A1 9/2010 Amento et al.
2010/0269889 A1 10/2010 Reinhold et al.
2010/0277400 A1 11/2010 Jeong
2010/0315319 A1 12/2010 Cok et al.
2010/0315449 A1 12/2010 Chaji
2010/0328294 A1 12/2010 Sasaki et al.
2011/0050741 A1 3/2011 Jeong
2011/0063197 A1 3/2011 Chung et al.
2011/0069089 A1 3/2011 Kopf et al.
2011/0074762 A1 3/2011 Shirasaki
2011/0084993 A1 4/2011 Kawabe
2011/0090210 A1 4/2011 Sasaki et al.
2011/0109350 A1 5/2011 Chaji et al.
2011/0133636 A1 6/2011 Matsuo et al.
2011/0169805 A1 7/2011 Katsunori
2011/0180825 A1 7/2011 Lee et al.
2011/0191042 A1 8/2011 Chaji
2011/0205221 A1 8/2011 Lin
2012/0026146 A1 2/2012 Kim
2012/0169793 A1 7/2012 Nathan
2012/0212468 A1 8/2012 Govil

(56) References Cited

U.S. PATENT DOCUMENTS

| | | | | |
|---|---|---|---|---|
| 2012/0299976 | A1 | 11/2012 | Chen et al. | |
| 2012/0299978 | A1 | 11/2012 | Chaji | |
| 2013/0009930 | A1 | 1/2013 | Cho et al. | |
| 2013/0032831 | A1 | 2/2013 | Chaji et al. | |
| 2013/0113785 | A1 | 5/2013 | Sumi | |
| 2013/0221856 | A1* | 8/2013 | Soto | G06F 3/0412 315/152 |
| 2014/0267215 | A1 | 9/2014 | Soni | |
| 2017/0076670 | A1* | 3/2017 | Chaji | G09G 3/3233 |

FOREIGN PATENT DOCUMENTS

| | | | |
|---|---|---|---|
| CA | 2 303 302 | | 3/1999 |
| CA | 2 368 386 | | 9/1999 |
| CA | 2 242 720 | | 1/2000 |
| CA | 2 354 018 | | 6/2000 |
| CA | 2 432 530 | | 7/2002 |
| CA | 2 436 451 | | 8/2002 |
| CA | 2 438 577 | | 8/2002 |
| CA | 2 507 276 | | 8/2002 |
| CA | 2 483 645 | | 12/2003 |
| CA | 2 463 653 | | 1/2004 |
| CA | 2 498 136 | | 3/2004 |
| CA | 2498136 | | 3/2004 |
| CA | 2 522 396 | | 11/2004 |
| CA | 2522396 | | 11/2004 |
| CA | 2 438 363 | | 2/2005 |
| CA | 2 443 206 | | 3/2005 |
| CA | 2 519 097 | | 3/2005 |
| CA | 2443206 | | 3/2005 |
| CA | 2 472 671 | | 12/2005 |
| CA | 2472671 | | 12/2005 |
| CA | 2 523 841 | | 1/2006 |
| CA | 2 567 076 | | 1/2006 |
| CA | 2567076 | | 1/2006 |
| CA | 2526782 | | 4/2006 |
| CA | 2 495 726 | | 7/2006 |
| CA | 2 557 713 | | 11/2006 |
| CA | 2 526 782 | C | 8/2007 |
| CA | 2 651 893 | | 11/2007 |
| CA | 2 672 590 | | 10/2009 |
| CN | 1381032 | | 11/2002 |
| CN | 1448908 | | 10/2003 |
| CN | 1601594 | A | 3/2005 |
| CN | 1776922 | | 5/2006 |
| CN | 1886774 | | 12/2006 |
| CN | 101395653 | | 3/2009 |
| DE | 20 2006 005427 | | 6/2006 |
| DE | 202006007613 | | 9/2006 |
| EP | 0 478 186 | | 4/1992 |
| EP | 0 940 796 | | 9/1999 |
| EP | 1 028 471 | A | 8/2000 |
| EP | 1 103 947 | | 5/2001 |
| EP | 1 130 565 | A1 | 9/2001 |
| EP | 1 184 833 | | 3/2002 |
| EP | 1 194 013 | | 4/2002 |
| EP | 1 310 939 | | 5/2003 |
| EP | 1 321 922 | | 6/2003 |
| EP | 1 335 430 | A1 | 8/2003 |
| EP | 1 372 136 | | 12/2003 |
| EP | 1 381 019 | | 1/2004 |
| EP | 1 418 566 | | 5/2004 |
| EP | 1 429 312 | A | 6/2004 |
| EP | 1 439 520 | | 7/2004 |
| EP | 1 439 520 | A2 | 7/2004 |
| EP | 1 465 143 | A | 10/2004 |
| EP | 1 467 408 | | 10/2004 |
| EP | 1 473 689 | A | 11/2004 |
| EP | 1 517 290 | | 3/2005 |
| EP | 1 517 290 | A2 | 3/2005 |
| EP | 1 521 203 | A2 | 4/2005 |
| EP | 2317499 | | 5/2011 |
| GB | 2 205 431 | | 12/1988 |
| GB | 2 399 935 | | 9/2004 |
| GB | 2 460 018 | | 11/2009 |
| JP | 09 090405 | | 4/1997 |
| JP | 10-153759 | | 6/1998 |
| JP | 10-254410 | | 9/1998 |
| JP | 11 231805 | | 8/1999 |
| JP | 11-282419 | | 10/1999 |
| JP | 2000/056847 | | 2/2000 |
| JP | 2000-077192 | | 3/2000 |
| JP | 2000-089198 | | 3/2000 |
| JP | 2000-352941 | | 12/2000 |
| JP | 2002-91376 | | 3/2002 |
| JP | 2002-268576 | | 9/2002 |
| JP | 2002-278513 | | 9/2002 |
| JP | 2002-333862 | | 11/2002 |
| JP | 2003-022035 | | 1/2003 |
| JP | 2003-076331 | | 3/2003 |
| JP | 2003-099000 | | 4/2003 |
| JP | 2003-150082 | | 5/2003 |
| JP | 2003-173165 | | 6/2003 |
| JP | 2003-177709 | | 6/2003 |
| JP | 2003-186439 | | 7/2003 |
| JP | 2003-195809 | | 7/2003 |
| JP | 2003-271095 | | 9/2003 |
| JP | 2003-308046 | | 10/2003 |
| JP | 2004-054188 | | 2/2004 |
| JP | 2004-226960 | | 8/2004 |
| JP | 2005-004147 | | 1/2005 |
| JP | 2005-057217 | | 3/2005 |
| JP | 2005-099715 | | 4/2005 |
| JP | 2005-258326 | | 9/2005 |
| JP | 2005-338819 | | 12/2005 |
| JP | 2006065148 | | 3/2006 |
| JP | 2009282158 | | 12/2009 |
| TW | 485337 | | 5/2002 |
| TW | 502233 | | 9/2002 |
| TW | 538650 | | 6/2003 |
| TW | 569173 | | 1/2004 |
| TW | 200526065 | | 8/2005 |
| TW | 1239501 | | 9/2005 |
| WO | WO 94/25954 | | 11/1994 |
| WO | WO 98/11554 | | 3/1998 |
| WO | WO 99/48079 | | 9/1999 |
| WO | WO 01/27910 | A1 | 4/2001 |
| WO | WO 02/067327 | A | 8/2002 |
| WO | WO 03/034389 | | 4/2003 |
| WO | WO 03/034389 | A | 4/2003 |
| WO | WO 03/063124 | | 7/2003 |
| WO | WO 03/075256 | | 9/2003 |
| WO | WO 03/077231 | | 9/2003 |
| WO | WO 03/105117 | | 12/2003 |
| WO | WO 2004/003877 | | 1/2004 |
| WO | WO 2004/015668 | A1 | 2/2004 |
| WO | WO 2004/034364 | | 4/2004 |
| WO | WO 2005/022498 | | 3/2005 |
| WO | WO 2005/029455 | | 3/2005 |
| WO | WO 2005/055185 | | 6/2005 |
| WO | WO 2005/055186 | A1 | 6/2005 |
| WO | WO 2005/069267 | | 7/2005 |
| WO | WO 2005/122121 | | 12/2005 |
| WO | WO 2006/053424 | | 5/2006 |
| WO | WO 2006/063448 | | 6/2006 |
| WO | WO 2006/063448 | A | 6/2006 |
| WO | WO 2006/128069 | | 11/2006 |
| WO | WO 2006/137337 | | 12/2006 |
| WO | WO 2007/003877 | A | 1/2007 |
| WO | WO 2007/079572 | | 7/2007 |
| WO | WO 2008/057369 | | 5/2008 |
| WO | WO 2008/0290805 | | 11/2008 |
| WO | WO 2009/059028 | | 5/2009 |
| WO | WO 2009/127065 | | 10/2009 |
| WO | WO 2010/023270 | | 3/2010 |
| WO | WO 2010/066030 | | 6/2010 |
| WO | WO 2010/120733 | | 10/2010 |

OTHER PUBLICATIONS

Alexander et al.: "Pixel circuits and drive schemes for glass and elastic AMOLED displays"; dated Jul. 2005 (9 pages).

(56) References Cited

OTHER PUBLICATIONS

Alexander et al.: "Unique Electrical Measurement Technology for Compensation, Inspection, and Process Diagnostics of AMOLED HDTV"; dated May 2010 (4 pages).
Ashtiani et al.: "AMOLED Pixel Circuit With Electronic Compensation of Luminance Degradation"; dated Mar. 2007 (4 pages).
Chaji et al.: "A Current-Mode Comparator for Digital Calibration of Amorphous Silicon AMOLED Displays"; dated Jul. 2008 (5 pages).
Chaji et al.: "A fast settling current driver based on the CCII for AMOLED displays"; dated Dec. 2009 (6 pages).
Chaji et al.: "A Low-Cost Stable Amorphous Silicon AMOLED Display with Full V~T- and V~O~L~E~D Shift Compensation"; dated May 2007 (4 pages).
Chaji et al.: "A low-power driving scheme for a-Si:H active-matrix organic light-emitting diode displays"; dated Jun. 2005 (4 pages).
Chaji et al.: "A low-power high-performance digital circuit for deep submicron technologies"; dated Jun. 2005 (4 pages).
Chaji et al.: "A novel a-Si:H AMOLED pixel circuit based on short-term stress stability of a-Si:H TFTs"; dated Oct. 2005 (3 pages).
Chaji et al.: "A Novel Driving Scheme and Pixel Circuit for AMOLED Displays"; dated Jun. 2006 (4 pages).
Chaji et al.: "A novel driving scheme for high-resolution large-area a-Si:H AMOLED displays"; dated Aug. 2005 (4 pages).
Chaji et al.: "A Stable Voltage-Programmed Pixel Circuit for a-Si:H AMOLED Displays"; dated Dec. 2006 (12 pages).
Chaji et al.: "A Sub-μA fast-settling current-programmed pixel circuit for AMOLED displays"; dated Sep. 2007.
Chaji et al.: "An Enhanced and Simplified Optical Feedback Pixel Circuit for AMOLED Displays"; dated Oct. 2006.
Chaji et al.: "Compensation technique for DC and transient instability of thin film transistor circuits for large-area devices"; dated Aug. 2008.
Chaji et al.: "Driving scheme for stable operation of 2-TFT a-Si AMOLED pixel"; dated Apr. 2005 (2 pages).
Chaji et al.: "Dynamic-effect compensating technique for stable a-Si:H AMOLED displays"; dated Aug. 2005 (4 pages).
Chaji et al.: "Electrical Compensation of OLED Luminance Degradation"; dated Dec. 2007 (3 pages).
Chaji et al.: "eUTDSP: a design study of a new VLIW-based DSP architecture"; dated May 2003 (4 pages).
Chaji et al.: "Fast and Offset-Leakage Insensitive Current-Mode Line Driver for Active Matrix Displays and Sensors"; dated Feb. 2009 (8 pages).
Chaji et al.: "High Speed Low Power Adder Design With a New Logic Style: Pseudo Dynamic Logic (SDL)"; dated Oct. 2001 (4 pages).
Chaji et al.: "High-precision, fast current source for large-area current-programmed a-Si flat panels"; dated Sep. 2006 (4 pages).
Chaji et al.: "Low-Cost AMOLED Television with IGNIS Compensating Technology"; dated May 2008 (4 pages).
Chaji et al.: "Low-Cost Stable a-Si:H AMOLED Display for Portable Applications"; dated Jun. 2006 (4 pages).
Chaji et al.: "Low-Power Low-Cost Voltage-Programmed a-Si:H AMOLED Display"; dated Jun. 2008 (5 pages).
Chaji et al.: "Merged phototransistor pixel with enhanced near infrared response and flicker noise reduction for biomolecular imaging"; dated Nov. 2008 (3 pages).
Chaji et al.: "Parallel Addressing Scheme for Voltage-Programmed Active-Matrix OLED Displays"; dated May 2007 (6 pages).
Chaji et al.: "Pseudo dynamic logic (SDL): a high-speed and low-power dynamic logic family"; dated 2002 (4 pages).
Chaji et al.: "Stable a-Si:H circuits based on short-term stress stability of amorphous silicon thin film transistors"; dated May 2006 (4 pages).
Chaji et al.: "Stable Pixel Circuit for Small-Area High-Resolution a-Si:H AMOLED Displays"; dated Oct. 2008 (6 pages).
Chaji et al.: "Stable RGBW AMOLED display with OLED degradation compensation using electrical feedback"; dated Feb. 2010 (2 pages).
Chaji et al.: "Thin-Film Transistor Integration for Biomedical Imaging and AMOLED Displays"; dated May 2008 (177 pages).
Chapter 3: Color Spaces Keith Jack: Video Demystified: "A Handbook for the Digital Engineer" 2001 Referex ORD-0000-00-00 USA EP040425529 ISBN: 1-878707-56-6 pp. 32-33.
Chapter 8: Alternative Flat Panel Display 1-25 Technologies ; Willem den Boer: "Active Matrix Liquid Crystal Display: Fundamentals and Applications" 2005 Referex ORD-0000-00-00 U.K.; XP040426102 ISBN: 0-7506-7813-5 pp. 206-209 p. 208.
European Partial Search Report Application No. 12 15 6251.6 European Patent Office dated May 30, 2012 (7 pages).
European Patent Office Communication Application No. 05 82 1114 dated Jan. 11, 2013 (9 pages).
European Patent Office Communication with Supplemental European Search Report for EP Application No. 07 70 1644.2 dated Aug. 18, 2009 (12 pages).
European Search Report and Written Opinion for Application No. 08 86 5338 dated Nov. 2, 2011 (7 pages).
European Search Report Application No. 10 83 4294.0-1903 dated Apr. 8, 2013 (9 pages).
European Search Report Application No. EP 05 80 7905 dated Apr. 2, 2009 (5 pages).
European Search Report Application No. EP 05 82 1114 dated Mar. 27, 2009 (2 pages).
European Search Report Application No. EP 07 70 1644 dated Aug. 5, 2009.
European Search Report Application No. EP 10 17 5764 dated Oct. 18, 2010 (2 pages).
European Search Report Application No. EP 10 82 9593.2 European Patent Office dated May 17, 2013 (7 pages).
European Search Report Application No. EP 12 15 6251.6 European Patent Office dated Oct. 12, 2012 (18 pages).
European Search Report Application No. EP. 11 175 225.9 dated Nov. 4, 2011 (9 pages).
European Search Report for European Application No. EP 04 78 6661 dated Mar. 9, 2009.
European Search Report for European Application No. EP 05 75 9141 dated Oct. 30, 2009.
European Search Report for European Application No. EP 05 82 1114 dated Mar. 27, 2009 (2 pages).
European Search Report for European Application No. EP 07 71 9579 dated May 20, 2009.
European Search Report dated Mar. 26, 2012 in corresponding European Patent Application No. 10000421.7 (6 pages).
European Supplementary Search Report Application No. EP 09 80 2309 dated May 8, 2011 (14 pages).
European Supplementary Search Report Application No. EP 09 83 1339.8 dated Mar. 26, 2012 (11 pages).
Extended European Search Report Application No. EP 06 75 2777.0 dated Dec. 6, 2010 (21 pages).
Extended European Search Report Application No. EP 09 73 2338.0 dated May 24, 2011 (8 pages).
Extended European Search Report Application No. EP 11 17 5223, 4 dated Nov. 8, 2011 (8 pages).
Extended European Search Report Application No. EP 12 17 4465.0 European Patent Office dated Sep. 7, 2012 (9 pages).
Extended European Search Report Application No. EP 15173106.4 dated Oct. 15, 2013 (8 pages).
Extended European Search Report for Application No. EP 14181848. 4, dated Mar. 5, 2015, (9 pages).
Extended European Search Report dated Apr. 27, 2011 issued during prosecution of European patent application No. 09733076.5 (13 pages).
Fan et al. "LTPS_TFT Pixel Circuit Compensation for TFT Threshold Voltage Shift and IR-Drop on the Power Line for Amolded Displays" 5 pages copyright 2012.
Goh et al. "A New a-Si:H Thin-Film Transistor Pixel Circuit for Active-Matrix Organic Light-Emitting Diodes" IEEE Electron Device Letters vol. 24 No. 9 Sep. 2003 pp. 583-585.
Goh et al., "A New a-Si:H Thin Film Transistor Pixel Circul for Active-Matrix Organic Light-Emitting Diodes", IEEE Electron Device Letters, vol. 24, No. 9, Sep. 2003, 4 pages.

(56) References Cited

OTHER PUBLICATIONS

International Search Report Application No. PCT/CA2005/001844 dated Mar. 28, 2006 (2 pages).
International Search Report Application No. PCT/CA2006/000941 dated Oct. 3, 2006 (2 pages).
International Search Report Application No. PCT/CA2007/000013 dated May 7, 2007.
International Search Report Application No. PCT/CA2009/001049 dated Dec. 7, 2009 (4 pages).
International Search Report Application No. PCT/CA2009/001769 dated Apr. 8, 2010.
International Search Report Application No. PCT/IB2010/002898 Canadian Intellectual Property Office dated Jul. 28, 2009 (5 pages).
International Search Report Application No. PCT/IB2010/055481 dated Apr. 7, 2011 (3 pages).
International Search Report Application No. PCT/IB2011/051103 dated Jul. 8, 2011 3 pages.
International Search Report Application No. PCT/IB2012/052651 5 pages dated Sep. 11, 2012.
International Search Report Application No. PCT/IB2013/059074, dated Dec. 18, 2013 (5 pages).
International Search Report for Application No. PCT/IB2014/059409, Canadian Intellectual Property Office, dated Jun. 12, 2014 (4 pages).
International Search Report for International Application No. PCT/CA02/00180 dated Jul. 31, 2002 (3 pages).
International Search Report for International Application No. PCT/CA2004/001741 dated Feb. 21, 2005.
International Search Report for International Application No. PCT/CA2005/001844 dated Mar. 28, 2006 (2 pages).
International Search Report for International Application No. PCT/CA2005/001007 dated Oct. 18, 2005.
International Search Report for International Application No. PCT/CA2007/000652 dated Jul. 25, 2007.
International Search Report for International Application No. PCT/CA2008/002307, dated Apr. 28, 2009 (3 pages).
International Search Report for International Application No. PCT/IB2011/055135, Canadian Patent Office, dated Apr. 16, 2012 (5 pages).
International Search Report dated Jul. 30, 2009 for International Application No. PCT/CA2009/000501 (4 pages).
International Searching Authority Written Opinion Application No. PCT/IB2010/055481 dated Apr. 7, 2011 (6 pages ).
International Searching Authority Written Opinion Application No. PCT/IB2012/052651 6 pages dated Sep. 11, 2012.
International Searching Authority Written Opinion Application No. PCT/IB2011/051103 dated Jul. 8, 2011 6 pages.
International Searching Authority Written Opinion Application No. PCT/IB2010/002898 Canadian Intellectual Property Office dated Mar. 30, 2011 (8 pages).
International Searching Authority Written Opinion Application No. PCT/CA2009/001769 dated Apr. 8, 2010 (8 pages).
International Searching Authority Written Opinion Application No. PCT/IB2013/059074, dated Dec. 18, 2013 (8 pages ).
Jafarabadiashtiani et al.: "A New Driving Method for a-Si AMOLED Displays Based on Voltage Feedback"; dated May 2005 (4 pages).
Lee et al.: "Ambipolar Thin-Film Transistors Fabricated by PECVD Nanocrystalline Silicon"; dated May 2006 (6 pages).
Ma e y et al: "Organic Light-Emitting Diode/Thin Film Transistor Integration for foldable Displays" Conference record of the 1997 International display research conference and international workshops on LCD technology and emissive technology. Toronto, Sep. 15-19, 1997 (6 pages).
Matsueda y et al.: "35.1: 2.5-in. AMOLED with Integrated 6-bit Gamma Compensated Digital Data Driver"; dated May 2004 (4 pages).
Nathan et al., "Amorphous Silicon Thin Film Transistor Circuit Integration for Organic LED Displays on Glass and Plastic", IEEE Journal of Solid-State Circuits, vol. 39, No. 9, Sep. 2004, pp. 1477-1486.
Nathan et al.: "Backplane Requirements for Active Matrix Organic Light Emitting Diode Displays"; dated Sep. 2006 (16 pages).
Nathan et al.: "Call for papers second international workshop on compact thin-film transistor (TFT) modeling for circuit simulation"; dated Sep. 2009 (1 page).
Nathan et al.: "Driving schemes for a-Si and LTPS AMOLED displays"; dated Dec. 2005 (11 pages).
Nathan et al.: "Invited Paper: a-Si for AMOLED—Meeting the Performance and Cost Demands of Display Applications (Cell Phone to HDTV)"; dated Jun. 2006 (4 pages).
Nathan et al.: "Thin film imaging technology on glass and plastic" ICM 2000, Proceedings of the 12$^{th}$ International Conference on Microelectronics, (IEEE Cat. No. 00EX453), Tehran Iran; dated Oct. 31-Nov. 2, 2000, pp. 11-14, ISBN: 964-360-057-2, p. 13, col. 1, line 11-48; (4 pages).
Nathan et al.: "Thin film imaging technology on glass and plastic"; dated Oct. 31-Nov. 2 2000 (4 pages).
Office Action issued in Chinese Patent Application 200910246264.4 dated Jul. 5, 2013; 8 pages.
Ono et al. "Shared Pixel Compensation Circuit for AM-OLED Displays " Proceedings of the 9$^{th}$ Asian Symposium on Information Display (ASID) pp. 462-465 New Delhi dated Oct. 8-12, 2006 (4 pages).
Patent Abstracts of Japan, vol. 2000, No. 09, Oct. 13, 2000—JP 2000 172199 A, Jun. 3, 2000, abstract.
Patent Abstracts of Japan, vol. 2002, No. 03, Apr. 3, 2002 (Apr. 4, 2004 & JP 2001 318627 A (Semiconductor EnergyLab DO LTD), Nov. 16, 2001, abstract, paragraphs '01331-01801, paragraph '01691, paragraph '01701, paragraph '01721 and figure 10.
Philipp: "Charge transfer sensing" Sensor Review, vol. 19, No. 2, Dec. 31, 1999 (Dec. 31, 1999), 10 pages.
Rafati et al.: "Comparison of a 17 b multiplier in Dual-rail domino and in Dual-rail D L (D L) logic styles"; dated 2002 (4 pages).
Safavaian et al.: "Three-TFT image sensor for real-time digital X-ray imaging"; dated Feb. 2, 2006 (2 pages).
Safavian et al.: "3-TFT active pixel sensor with correlated double sampling readout circuit for real-time medical x-ray imaging"; dated Jun. 2006 (4 pages).
Safavian et al.: "A novel current scaling active pixel sensor with correlated double sampling readout circuit for real time medical x-ray imaging"; dated May 2007 (7 pages).
Safavian et al.: "A novel hybrid active-passive pixel with correlated double sampling CMOS readout circuit for medical x-ray imaging"; dated May 2008 (4 pages).
Safavian et al.: "Self-compensated a-Si:H detector with current-mode readout circuit for digital X-ray fluoroscopy"; dated Aug. 2005 (4 pages).
Safavian et al.: "TFT active image sensor with current-mode readout circuit for digital x-ray fluoroscopy [5969D-82]"; dated Sep. 2005 (9 pages).
Sanford, James L., et al., "4.2 TFT AMOLED Pixel Circuits and Driving Methods", SID 03 Digest, ISSN/0003, 2003, pp. 10-13.
Smith, Lindsay I., "A tutorial on Principal Components Analysis," dated Feb. 26, 2001 (27 pages).
Stewart M. et al., "Polysilicon TFT technology for active matrix OLED displays" IEEE transactions on electron devices, vol. 48, No. 5; Dated May 2001 (7 pages).
Tatsuya Sasaoka et al., 24.4L; Late-News Paper: A 13.0-inch AM-Oled Display with Top Emitting Structure and Adaptive Current Mode Programmed Pixel Circuit (TAC), SID 01 Digest, (2001), pp. 384-387.
Vygranenko et al.: "Stability of indium-oxide thin-film transistors by reactive ion beam assisted deposition"; dated Feb. 2009.
Wang et al.: "Indium oxides by reactive ion beam assisted evaporation: From material study to device application"; dated Mar. 2009 (6 pages).
Written Opinion for Application No. PCT/IB2014/059409, Canadian Intellectual Property Office, dated Jun. 12, 2014 (5 pages).
Written Opinion dated Jul. 30, 2009 for International Application No. PCT/CA2009/000501 (6 pages).
Yi He et al., "Current-Source a-Si:H Thin Film Transistor Circuit for Active-Matrix Organic Light-Emitting Displays", IEEE Electron Device Letters, vol. 21, No. 12, Dec. 2000, pp. 590-592.

(56) References Cited

OTHER PUBLICATIONS

Zhiguo Meng et al; "24.3: Active-Matrix Organic Light-Emitting Diode Display implemented Using Metal-Induced Unilaterally Crystallized Polycrystalline Silicon Thin-Film Transistors", SID 01Digest, (2001), pp. 380-383.

* cited by examiner

SYSTEMS AND METHODS OF HYBRID CALIBRATION OF BIAS CURRENT

PRIORITY CLAIM

This application claims priority to Canadian Application No. 2,898,282, filed Jul. 24, 2015, which is hereby incorporated by reference herein in its entirety.

FIELD OF THE INVENTION

The present disclosure relates to current biasing for pixels of light emissive visual display technology, and particularly to systems and methods for programming and calibrating pixel current biasing in active matrix light emitting diode device (AMOLED) and other emissive displays.

BRIEF SUMMARY

According to a first aspect there is provided a system for providing biasing currents to pixels of an emissive display system, each pixel having a light-emitting device, the system comprising: a plurality of current biasing elements; a plurality of current bias lines coupling said plurality of current biasing elements to said pixels; and a controller coupled to said current biasing elements for controlling a programming of said current biasing elements over a plurality of signal lines; wherein each current biasing element comprises: at least one current driving transistor coupled to a current bias line for providing a biasing current over the current bias line; and a storage capacitance for being programmed and for setting a magnitude of the biasing current provided by the at least one current driving transistor; wherein the controller's controlling the programming of each current biasing element comprises: during a programming cycle charging the storage capacitance to a defined level; and subsequent to the programming cycle, during a calibration cycle, partially discharging the storage capacitance as a function of characteristics of the at least one driving transistor.

In some embodiments, the plurality of signal lines comprises a plurality of data lines coupling a source driver of the emissive display system to the pixels and for programming said pixels, the data lines for coupling the controller and the plurality of current biasing elements at times different from when the data lines couple the source driver to the pixels.

Some embodiments further provide for a reference monitor line shared by the plurality of current biasing elements and coupling the plurality of current biasing elements to the controller.

In some embodiments, each current biasing element is a current sink, wherein the at least one current driving transistor comprises a single current driving transistor, wherein the storage capacitance is coupled across a gate of said current driving transistor and one of a source and drain of said current driving transistor, the other of said source and drain of said current driving transistor coupled to a voltage supply, wherein during the calibration cycle, the current driving transistor is allowed to partially discharge said storage capacitance through the current driving transistor to said voltage supply.

In some embodiments, each current biasing element is a current source, wherein the at least one current driving transistor comprises a single current driving transistor, wherein the storage capacitance is coupled across a gate of said current driving transistor and one of a source and drain of said current driving transistor, the one of said source and drain of said current driving transistor coupled to a voltage supply, wherein during the calibration cycle, the current driving transistor is allowed to partially discharge said storage capacitance through the current driving transistor to said voltage supply.

According to another aspect there is provided a system for providing biasing currents to pixels of an emissive display system, each pixel having a light-emitting device, the system comprising: a plurality of current biasing elements; a plurality of current bias lines coupling said plurality of current biasing elements to said pixels; a controller coupled to said current biasing elements for controlling a programming of said current biasing elements over a plurality of signal lines; and a monitor coupled to the plurality of current biasing elements for monitoring a biasing current produced by each current biasing element and for storing in a memory a measurement representing said biasing current for each current biasing element; wherein each current biasing element comprises: at least one current driving transistor coupled to a current bias line for providing a biasing current over the current bias line; and a storage capacitance for being programmed and for setting a magnitude of the biasing current provided by the at least one current driving transistor; wherein the controller's controlling the programming of each current biasing element comprises: retrieving from said memory said measurement representing said biasing current for the current biasing element; determining a deviation of said biasing current represented by said measurement from an expected biasing current; and charging the storage capacitance to a defined compensated level which compensates for said deviation so that said current biasing element produces the expected biasing current.

Some embodiments further provide for a reference monitor line shared by the plurality of current biasing elements and coupling the plurality of current biasing elements to the controller, the controller coupled to the monitor.

According to another aspect, there is provided a method of providing biasing currents to pixels of an emissive display system, each pixel having a light-emitting device, the emissive display system including a plurality of current biasing elements and a plurality of current bias lines coupling said plurality of current biasing elements to said pixels, each current biasing element including at least one current driving transistor coupled to a current bias line for providing a biasing current over the current bias line and a storage capacitance for being programmed and for setting a magnitude of the biasing current provided by the at least one current driving transistor, the method comprising: programming each current biasing element over a plurality of signal lines comprising: charging the storage capacitance to a defined level during a programming cycle; and subsequent to the programming cycle, during a calibration cycle, partially discharging the storage capacitance as a function of characteristics of the at least one driving transistor.

In some embodiments, the plurality of signal lines comprises a plurality of data lines coupling a source driver of the emissive display system to the pixels and for programming said pixels, the data lines for coupling the controller and the plurality of current biasing elements for performing said programming each current biasing element at times different from when the data lines couple the source driver to the pixels.

In some embodiments, a reference monitor line is shared by the plurality of current biasing elements and wherein said charging said storage capacitance comprises coupling to the controller over said reference monitor line each current biasing element being charged while de-coupling from the controller current biasing elements not being charged.

In some embodiments, each current biasing element is a current sink, wherein the at least one current driving transistor comprises a single current driving transistor, wherein the storage capacitance is coupled across a gate of said current driving transistor and one of a source and drain of said current driving transistor, the other of said source and drain of said current driving transistor coupled to a voltage supply, wherein during the calibration cycle, partially discharging the storage capacitance comprises allowing the current driving transistor to partially discharge said storage capacitance through the current driving transistor to said voltage supply.

In some embodiments, each current biasing element is a current source, wherein the at least one current driving transistor comprises a single current driving transistor, wherein the storage capacitance is coupled across a gate of said current driving transistor and one of a source and drain of said current driving transistor, the one of said source and drain of said current driving transistor coupled to a voltage supply, wherein during the calibration cycle, partially discharging the storage capacitance comprises allowing the current driving transistor to partially discharge said storage capacitance through the current driving transistor to said voltage supply.

According to another aspect there is provided a method of providing biasing currents to pixels of an emissive display system, each pixel having a light-emitting device, the emissive display system including a plurality of current biasing elements, a plurality of current bias lines coupling said plurality of current biasing elements to said pixels, each current biasing element including at least one current driving transistor coupled to a current bias line for providing a biasing current over the current bias line and a storage capacitance for being programmed and for setting a magnitude of the biasing current provided by the at least one current driving transistor, the method comprising: monitoring a biasing current produced by each current biasing element; storing in a memory a measurement representing said biasing current for each current biasing element; and programming each current biasing element over a plurality of signal lines comprising: retrieving from said memory said measurement representing said biasing current for the current biasing element; determining a deviation of said biasing current represented by said measurement from an expected biasing current; and charging the storage capacitance to a defined compensated level which compensates for said deviation so that said current biasing element produces the expected biasing current.

In some embodiments, the controller is coupled to the monitor, a reference monitor line is shared by the plurality of current biasing elements and wherein said monitoring each current biasing element comprises coupling to the controller over the reference monitor line each current biasing element being measured while de-coupling from the controller current biasing elements not being measured.

The foregoing and additional aspects and embodiments of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the disclosure will become apparent upon reading the following detailed description and upon reference to the drawings.

Figure 1:
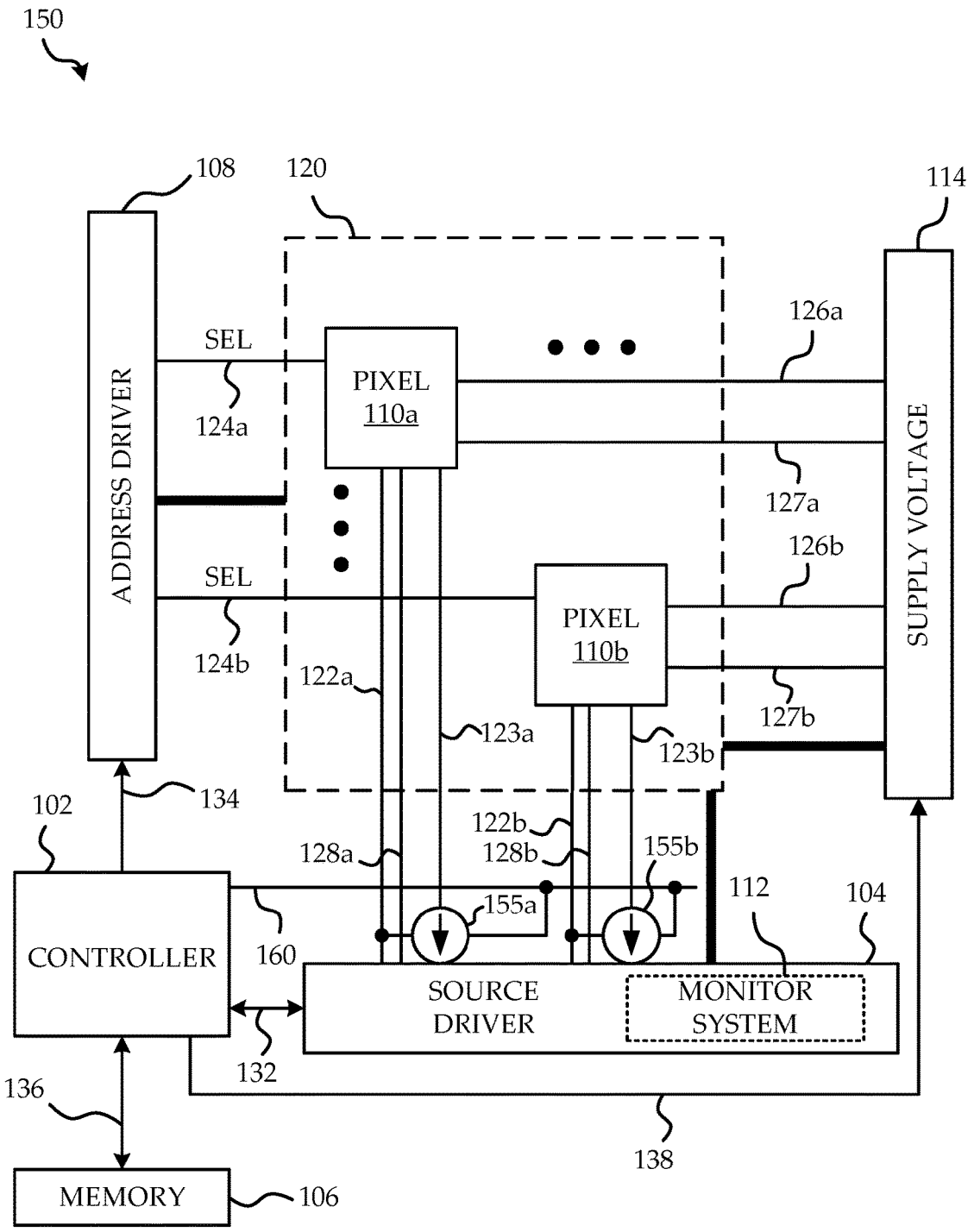
FIG. 1 illustrates an example display system utilizing the methods and comprising the current biasing elements disclosed.

While the present disclosure is susceptible to various modifications and alternative forms, specific embodiments or implementations have been shown by way of example in the drawings and will be described in detail herein. It should be understood, however, that the disclosure is not intended to be limited to the particular forms disclosed. Rather, the disclosure is to cover all modifications, equivalents, and alternatives falling within the spirit and scope of an invention as defined by the appended claims.

DETAILED DESCRIPTION

Many modern display technologies suffer from defects, variations, and non-uniformities, from the moment of fabrication, and can suffer further from aging and deterioration over the operational lifetime of the display, which result in the production of images which deviate from those which are intended. Methods of image calibration and compensation are used to correct for those defects in order to produce images which are more accurate, uniform, or otherwise more closely reproduces the image represented by the image data. Some displays utilize a current-bias voltage-programming driving scheme, each of its pixels being a current-biased voltage-programmed (CBVP) pixel. In such displays a further requirement for producing and maintaining accurate image reproduction is that the current biasing elements, that is the current sources or sinks, which provide current biasing provide the appropriate level of current biasing to those pixels. Due to unavoidable variations in fabrication and variations in degradation through use, a number of current biasing elements provided for a display, although designed to be uniformly and exactly alike and programmed to provide the desired current biasing level, in fact exhibit deviations in current biasing provided. In order to correct for visual defects that would otherwise arise from the non-uniformity and inaccuracies of these current sources or sinks, the programming of the current biasing elements is augmented with calibration and optionally monitoring and compensation.

As the resolution of an array semiconductor device increases, the number of lines and elements required to drive, calibrate, and/or monitor the array increases dramatically. This can result in higher power consumption, higher manufacturing costs, and a larger physical foot print. In the case of a CBVP pixel display, providing circuitry to program, calibrate, and monitor current sources or sinks can increase cost and complexity of integration as the number of rows or columns increases.

The systems and methods disclosed below address these issues through control and calibration of a family of current biasing elements while utilizing circuits which are integrated on the display in a manner which use existing display components.

While the embodiments described herein will be in the context of AMOLED displays it should be understood that the systems and methods described herein are applicable to any other display comprising pixels which might utilize current biasing, including but not limited to light emitting diode displays (LED), electroluminescent displays (ELD), organic light emitting diode displays (OLED), plasma display panels (PSP), among other displays.

It should be understood that the embodiments described herein pertain to systems and methods of calibration and compensation and do not limit the display technology underlying their operation and the operation of the displays in which they are implemented. The systems and methods described herein are applicable to any number of various types and implementations of various visual display technologies.

FIG. 1 is a diagram of an example display system 150 implementing the methods and comprising the circuits described further below. The display system 150 includes a display panel 120, an address driver 108, a source driver 104, a controller 102, and a memory storage 106.

The display panel 120 includes an array of pixels 110*a* 110*b* (only two explicitly shown) arranged in rows and columns. Each of the pixels 110*a* 110*b* is individually programmable to emit light with individually programmable luminance values and is a current biased voltage programmed pixel (CBVP). The controller 102 receives digital data indicative of information to be displayed on the display panel 120. The controller 102 sends signals 132 to the source driver 104 and scheduling signals 134 to the address driver 108 to drive the pixels 110 in the display panel 120 to display the information indicated. The plurality of pixels 110 of the display panel 120 thus comprise a display array or display screen adapted to dynamically display information according to the input digital data received by the controller 102. The display screen can display images and streams of video information from data received by the controller 102. The supply voltage 114 provides a constant power voltage or can serve as an adjustable voltage supply that is controlled by signals from the controller 102. The display system 150 incorporates features from current biasing elements 155*a*, 155*b*, either current sources or sinks (current sinks are shown) to provide biasing currents to the pixels 110*a* 110*b* in the display panel 120 to thereby decrease programming time for the pixels 110. Although shown separately from the source driver 104, current biasing elements 155*a*, 155*b* may form part of the source driver 104 or may be integrated as separate elements. It is to be understood that the current biasing elements 155*a*, 155*b* used to provide current biasing to the pixels may be current sources rather than current sinks depicted in FIG. 1.

For illustrative purposes, only two pixels 110*a*, 110*b* are explicitly shown in the display system 150 in FIG. 1. It is understood that the display system 150 is implemented with a display screen that includes an array of pixels, such as the pixels 110*a*, 110*b*, and that the display screen is not limited to a particular number of rows and columns of pixels. For example, the display system 150 can be implemented with a display screen with a number of rows and columns of pixels commonly available in displays for mobile devices, monitor-based devices, and/or projection-devices. In a multichannel or color display, a number of different types of pixels, each responsible for reproducing color of a particular channel or color such as red, green, or blue, will be present in the display. Pixels of this kind may also be referred to as "subpixels" as a group of them collectively provide a desired color at a particular row and column of the display, which group of subpixels may collectively also be referred to as a "pixel".

Each pixel 110*a*, 110*b* is operated by a driving circuit or pixel circuit that generally includes a driving transistor and a light emitting device. Hereinafter the pixel 110*a*, 110*b* may refer to the pixel circuit. The light emitting device can optionally be an organic light emitting diode, but implementations of the present disclosure apply to pixel circuits having other electroluminescence devices, including current-driven light emitting devices and those listed above. The driving transistor in the pixel 110*a*, 110*b* can optionally be an n-type or p-type amorphous silicon thin-film transistor, but implementations of the present disclosure are not limited to pixel circuits having a particular polarity of transistor or only to pixel circuits having thin-film transistors. The pixel circuit 110*a*, 110*b* can also include a storage capacitor for storing programming information and allowing the pixel circuit 110 to drive the light emitting device after being addressed. Thus, the display panel 120 can be an active matrix display array.

As illustrated in FIG. 1, each of the pixels 110*a*, 110*b* in the display panel 120 are coupled to a respective select line 124*a*, 124*b*, a respective supply line 126*a*, 126*b*, a respective data line 122*a*, 122*b*, a respective current bias line 123*a*, 123*b*, and a respective monitor line 128*a*, 128*b*. A read line may also be included for controlling connections to the monitor line. In one implementation, the supply voltage 114 can also provide a second supply line to each pixel 110*a*, 110*b*. For example, each pixel can be coupled to a first supply line 126*a*, 126*b* charged with Vdd and a second supply line 127*a*, 127*b* coupled with Vss, and the pixel circuits 110*a*, 110*b* can be situated between the first and second supply lines to facilitate driving current between the two supply lines during an emission phase of the pixel circuit. It is to be understood that each of the pixels 110 in the pixel array of the display 120 is coupled to appropriate select lines, supply lines, data lines, and monitor lines. It is noted that aspects of the present disclosure apply to pixels having additional connections, such as connections to additional select lines, and to pixels having fewer connections, and pixels sharing various connections.

With reference to the pixel 110*a* of the display panel 120, the select line 124*a* is provided by the address driver 108, and can be utilized to enable, for example, a programming operation of the pixel 110*a* by activating a switch or transistor to allow the data line 122*a* to program the pixel 110*a*. The data line 122*a* conveys programming information from the source driver 104 to the pixel 110*a*. For example, the data line 122*a* can be utilized to apply a programming voltage or a programming current to the pixel 110*a* in order to program the pixel 110*a* to emit a desired amount of luminance. The programming voltage (or programming current) supplied by the source driver 104 via the data line 122*a* is a voltage (or current) appropriate to cause the pixel 110*a* to emit light with a desired amount of luminance according to the digital data received by the controller 102. The programming voltage (or programming current) can be applied to the pixel 110*a* during a programming operation of the pixel 110*a* so as to charge a storage device within the pixel 110*a*, such as a storage capacitor, thereby enabling the pixel 110*a* to emit light with the desired amount of luminance during an emission operation following the programming operation. For example, the storage device in the pixel 110*a* can be charged during a programming operation to apply a voltage to one or more of a gate or a source terminal of the driving transistor during the emission operation, thereby causing the driving transistor to convey the driving current through the light emitting device according to the voltage stored on the storage device. Current biasing element 155*a* provides a biasing current to the pixel 110*a* over the current bias line 123*a* in the display panel 120 to thereby decrease programming time for the pixel 110*a*. The current biasing element 155*a* is also coupled to the data line 122*a* and uses the data line 122*a* to program its current output when not in use to program the pixels, as described hereinbelow. In some embodiments, the current biasing elements 155*a*, 155*b* are also coupled to a reference/monitor line 160 which is coupled to the controller 102, for monitoring and controlling of the current biasing elements 155*a*, 155*b*.

Generally, in the pixel 110*a*, the driving current that is conveyed through the light emitting device by the driving transistor during the emission operation of the pixel 110*a* is a current that is supplied by the first supply line 126*a* and is drained to a second supply line 127*a*. The first supply line 126*a* and the second supply line 127*a* are coupled to the voltage supply 114. The first supply line 126*a* can provide a positive supply voltage (e.g., the voltage commonly referred to in circuit design as "Vdd") and the second supply line 127*a* can provide a negative supply voltage (e.g., the voltage commonly referred to in circuit design as "Vss"). Implementations of the present disclosure can be realized where one or the other of the supply lines (e.g., the supply line 127*a*) is fixed at a ground voltage or at another reference voltage.

The display system 150 also includes a monitoring system 112. With reference again to the pixel 110*a* of the display panel 120, the monitor line 128*a* connects the pixel 110*a* to the monitoring system 112. The monitoring system 112 can be integrated with the source driver 104, or can be a separate stand-alone system. In particular, the monitoring system 112 can optionally be implemented by monitoring the current and/or voltage of the data line 122*a* during a monitoring operation of the pixel 110*a*, and the monitor line 128*a* can be entirely omitted. The monitor line 128*a* allows the monitoring system 112 to measure a current or voltage associated with the pixel 110*a* and thereby extract information indicative of a degradation or aging of the pixel 110*a* or indicative of a temperature of the pixel 110*a*. In some embodiments, display panel 120 includes temperature sensing circuitry devoted to sensing temperature implemented in the pixels 110*a*, while in other embodiments, the pixels 110*a* comprise circuitry which participates in both sensing temperature and driving the pixels. For example, the monitoring system 112 can extract, via the monitor line 128*a*, a current flowing through the driving transistor within the pixel 110*a* and thereby determine, based on the measured current and based on the voltages applied to the driving transistor during the measurement, a threshold voltage of the driving transistor or a shift thereof. In some embodiments the monitoring system 112 extracts information regarding the current biasing elements via data lines 122*a*, 122*b* or the reference/monitor line 160 and in some embodiments this is performed in cooperation with or by the controller 102.

The monitoring system 112 can also extract an operating voltage of the light emitting device (e.g., a voltage drop across the light emitting device while the light emitting device is operating to emit light). The monitoring system 112 can then communicate signals 132 to the controller 102 and/or the memory 106 to allow the display system 150 to store the extracted aging information in the memory 106. During subsequent programming and/or emission operations of the pixel 110*a*, the aging information is retrieved from the memory 106 by the controller 102 via memory signals 136, and the controller 102 then compensates for the extracted degradation information in subsequent programming and/or emission operations of the pixel 110*a*. For example, once the degradation information is extracted, the programming information conveyed to the pixel 110*a* via the data line 122*a* can be appropriately adjusted during a subsequent programming operation of the pixel 110*a* such that the pixel 110*a* emits light with a desired amount of luminance that is independent of the degradation of the pixel 110*a*. In an example, an increase in the threshold voltage of the driving transistor within the pixel 110*a* can be compensated for by appropriately increasing the programming voltage applied to the pixel 110*a*. In a similar manner, the monitoring system 112 can extract the bias current of a current biasing element 155*a*. The monitoring system 112 can then communicate signals 132 to the controller 102 and/or the memory 106 to allow the display system 150 to store the extracted information in the memory 106. During subsequent programming of the current biasing element 155*a*, the information is retrieved from the memory 106 by the controller 102 via memory signals 136, and the controller 102 then compensates for the errors in current previously measured using adjustments in subsequent programming of the current biasing element 155*a*.

Figure 2:
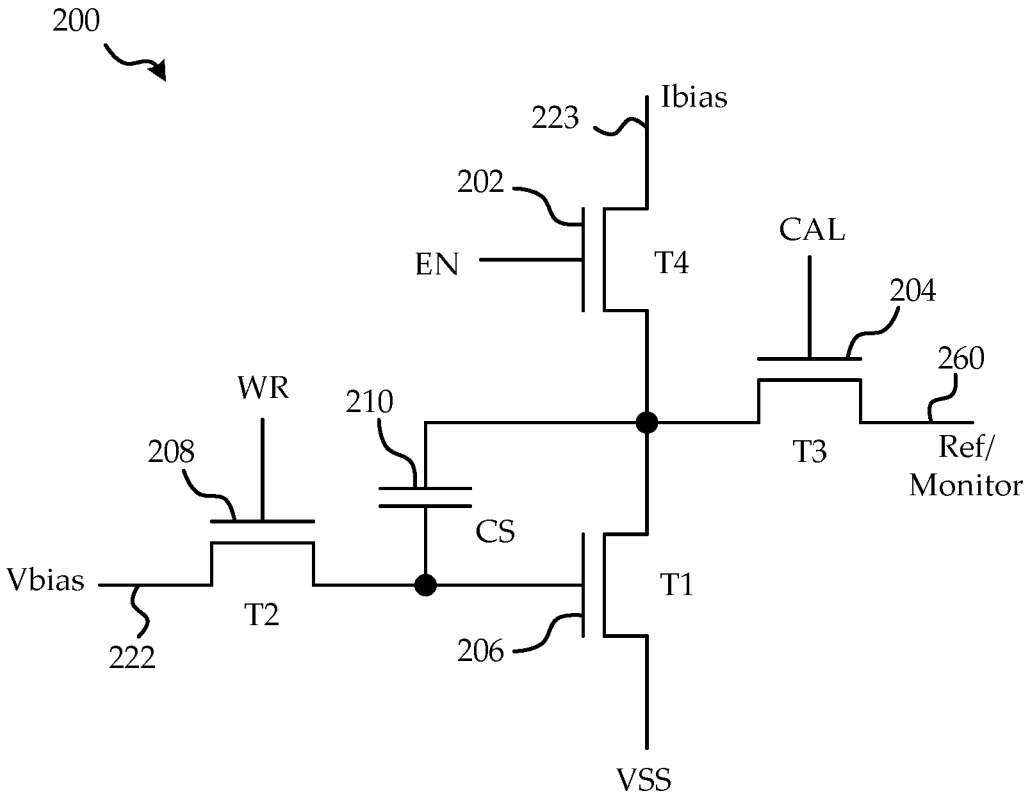
FIG. 2 is a circuit diagram of a current sink according to one embodiment.

Referring to FIG. 2, the structure of a current sink 200 circuit according to an embodiment will now be described. The current sink 200 corresponds, for example, to a single current biasing element 155*a*, 155*b* of the display system 150 depicted in FIG. 1 which provides a bias current Ibias over current bias lines 123*a*, 123*b* to a CBVP pixel 110*a*, 110*b*. The current sink 200 depicted in FIG. 2 is based on PMOS transistors. A PMOS based current source is also contemplated, structured and functioning according to similar principles described here. It should be understood that variations of this current sink and its functioning are contemplated and include different types of transistors (PMOS, NMOS, or CMOS) and different semiconductor materials (e.g., LTPS, Metal Oxide, etc.).

The current sink 200 includes a first switch transistor 202 (T4) controlled by an enable signal EN coupled to its gate terminal, and being coupled via one of a source and drain terminal to a current bias line 223 (Ibias) corresponding to, for example, a current bias line 123*a* of FIG. 1, and coupled via the other of the source and drain terminals of the first switch transistor 202 to a first terminal of a storage capacitance 210. A gate terminal of a current drive transistor 206 (T1) is coupled to a second terminal of the storage capacitance 210, while one of the source and gate terminals of the current drive transistor 206 is coupled to the first terminal of the storage capacitance 210. The other of the source and gate terminals of the current drive transistor 206 is coupled to VSS. A gate terminal of a second switch transistor 208 (T2) is coupled to a write signal line (WR), while one of its source and drain terminals is coupled to a voltage bias or data line (Vbias) 222, corresponding, for example, to data line 122*a* depicted in FIG. 1. The other of the source and drain terminals of the second switch transistor 208 is coupled to the second terminal of the storage capacitance 210. A gate terminal of a third switch transistor 204 (T3) is coupled to a calibration control line (CAL), while one of its source and drain terminals is coupled to a reference monitor line 260, corresponding, for example, to reference monitor line 160 depicted in FIG. 1. The other of the source and drain terminals of the third switch transistor 204 is coupled to the first terminal of the storage capacitance 210. As mentioned above the data lines are shared, being used for providing voltage biasing or data for the pixels during certain time periods during a frame and being used for providing voltage biasing for the current biasing element, here a current sink, during other time periods of a frame. This re-use of the data lines allows for the added benefits of programming and compensation of the numerous individual current sinks using only one extra reference monitoring line 160.

Figure 3:
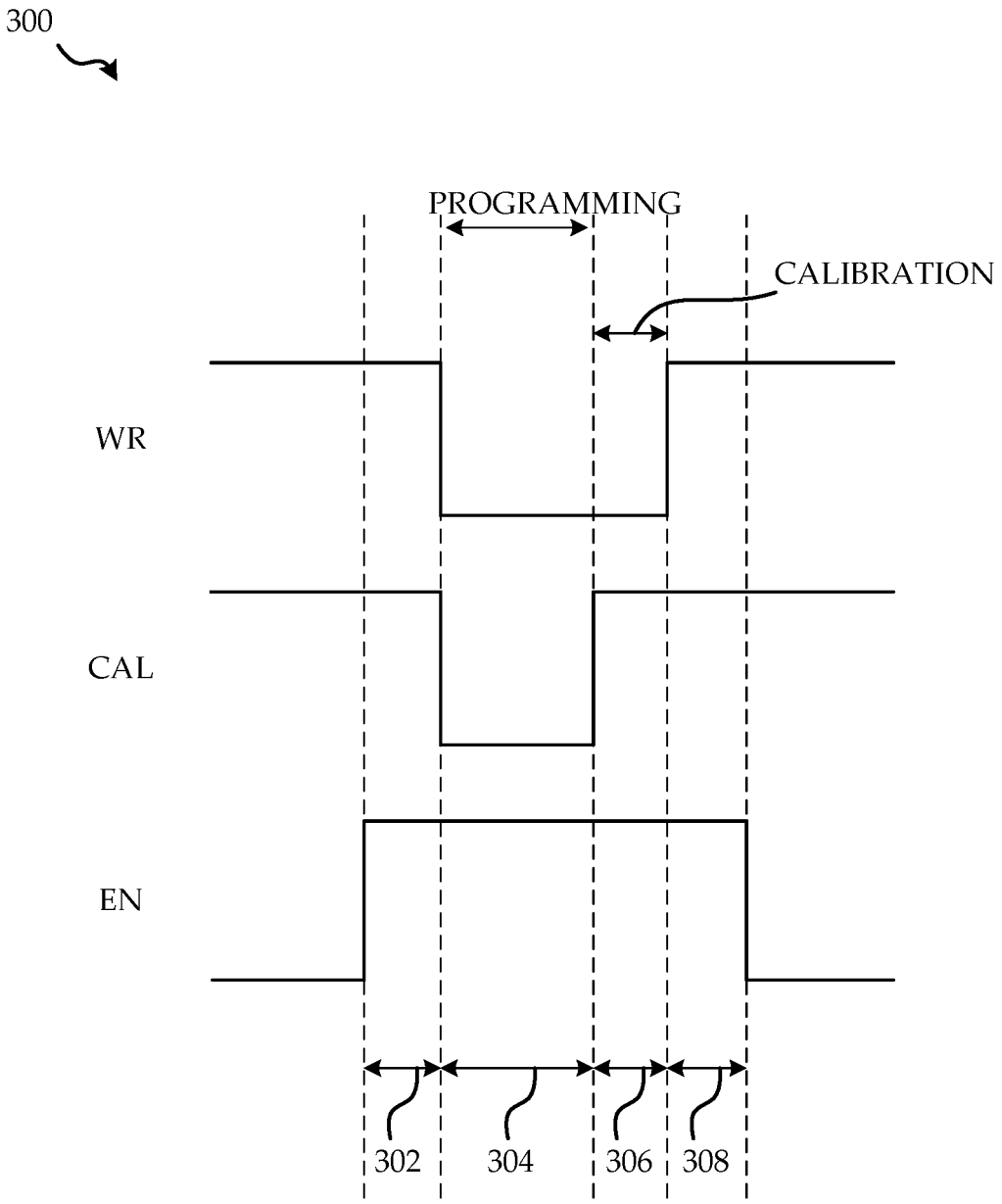
FIG. 3 is a timing diagram of current sink and source programming and calibration according to one embodiment.

With reference also to FIG. 3, an example of a timing of a current control cycle 300 for programming and calibrating the current sink 200 depicted in FIG. 2 will now be described. The complete control cycle 300 occurs typically once per frame and includes four smaller cycles, a disconnect cycle 302, a programming cycle 304, a calibration cycle 306, and a settling cycle 308. During the disconnect cycle 302, the current sink 200 ceases to provide biasing current Ibias to the current bias line 223 in response to the EN signal going high and the first transistor switch 202 turning off. By virtue of the CAL and WR signals being high, both the second and third switch transistors 208, 204 remain off. The duration of the disconnect cycle 302 also provides a settling time for the current sink 200 circuit. The EN signal remains high throughout the entire control cycle 300, only going low once the current sink 200 circuit has been programmed, calibrated, and settled and is ready to provide the bias current over the current bias line 223. Once the current sink 200 has settled after the disconnect cycle 302 has completed, the programming cycle 304 begins with the WR signal going low turning on the second switch transistor 208 and with the CAL signal going low turning on the third switch transistor 204. During the programming cycle 304 therefore, the third switch transistor 204 connects the reference monitor line 260 over which there is transmitted a known reference signal (can be voltage or current) to the first terminal of the storage capacitance 210, while the second switch transistor 208 connects the voltage bias or data line 222 being input with voltage Vbias to the gate terminal of the current driving transistor 206 and the second terminal of the storage capacitance 210. As a result, the storage capacitance 210 is charged to a defined value. This value is roughly that which is anticipated as necessary to control the current driving transistor 206 to deliver the appropriate current biasing Ibias taking into account optional calibration described below.

After the programming cycle 304 and during the calibration cycle 306, the circuit is reconfigured to discharge some of the voltage (charge) of the storage capacitance 210 though the current driving transistor 206. The calibration signal CAL goes high, turning off the third switch transistor 204 and disconnecting the first terminal of the storage capacitance 210 from the reference monitor line 260. The amount discharged is a function of the main element of the current sink 200, namely the current driving transistor 206 or its related components. For example, if the current driving transistor 206 is "strong", the discharge occurs relatively quickly and relatively more charge is discharged from the storage capacitance 210 through the current driving transistor 206 during the fixed duration of the calibration cycle 306. On the other hand, if the current driving transistor 206 is "weak," the discharge occurs relatively slowly and relatively less charge is discharged from the storage capacitance 210 through the current driving transistor 206 during the fixed duration of the calibration cycle 306. As a result the voltage (charge) stored in the storage capacitance 210 is reduced comparatively more for relatively strong current driving transistors versus comparatively less for relatively weak current driving transistors thereby providing some compensation for non-uniformity and variations in current driving transistors across the display whether due to variations in fabrication or variations in degradation over time.

After the calibration cycle 306, a settling cycle 308 is performed prior to provision of the biasing current Ibias to the current bias line 223. During the settling cycle 308, the first and third switch transistors 202, 204 remain off while the WR signal goes high to also turn the second switch transistor 208 off. After completion of the duration of the settling cycle 308, the enable signal EN goes low turning on the first switch transistor 202 and allowing the current driving transistor 206 to sink the Ibias current on the current bias line 223 according to the voltage (charge) stored in the storage capacitance 210, which as mentioned above, has a value which has been drained as a function of the current driving transistor 206 in order to provide compensation for the specific characteristics of the current driving transistor 206.

In some embodiments, the calibration cycle 306 is eliminated. In such a case, the compensation manifested as a change in the voltage (charge) stored by the storage capacitance 210 as a function of the characteristics of the current driving transistor 206 is not automatically provided. In such a case a form of manual compensation may be utilized in combination with monitoring.

In some embodiments, after a current sink 200 has been programmed, and prior to providing the biasing current over the current bias line 223, the current of the current sink 200 is measured through the reference monitor line 260 by controlling the CAL signal to go low, turning on the third switch transistor 204. As illustrated in FIG. 1, in some embodiments the reference monitor line 160 is shared and hence during measurement of the current sink 200 of interest all other current sinks are programmed or otherwise controlled such that they do not source or sink any current on the reference monitor line 160. Once the current of the current sink 200 has been measured in response to known programming of the current sink 200 and possibly after a number of various current measurements in response to various programming values have been measured and stored in memory 106, the controller 102 and memory 106 (possibly in cooperation with other components of the display system 150) adjusts the voltage Vbias used to program the current sink 200 to compensate for the deviations from the expected or desired current sinking exhibited by the current sink 200. This monitoring and compensation, need not be performed every frame and can be performed in a periodic manner over the lifetime of the display to correct for degradation of the current sink 200.

In some embodiments a combination of calibration and monitoring and compensation is used. In such a case the calibration can occur every frame in combination with periodic monitoring and compensation.

Figure 4:
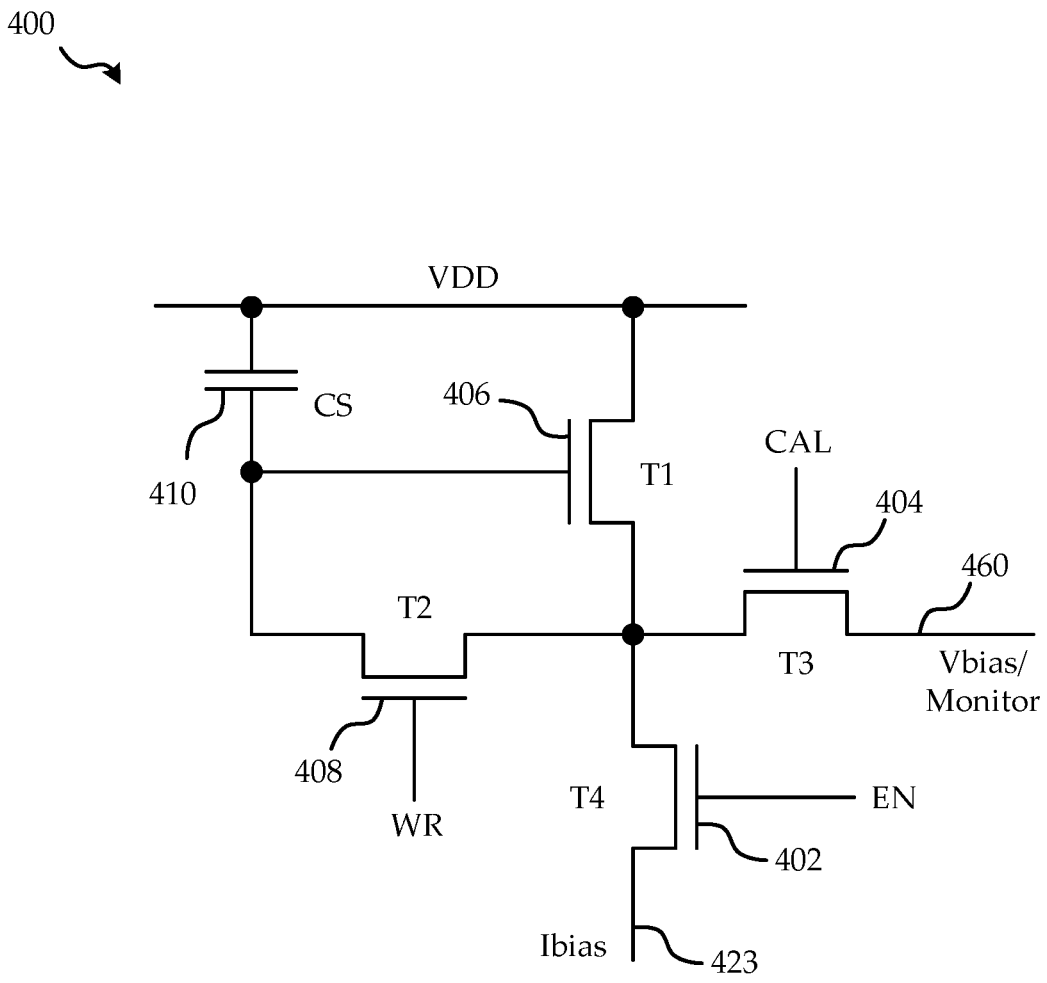
FIG. 4 is a circuit diagram of a current source according to a further embodiment.

Referring to FIG. 4, the structure of a current source 400 circuit according to an embodiment will now be described. The current source 400 corresponds, for example, to a single current biasing element 155*a*, 155*b* of the display system 150 depicted in FIG. 1 which provides a bias current Ibias over current bias lines 123*a*, 123*b* to a CBVP pixel 110*a*, 110*b*. As is described in more detail below, the connections and manner of integration of current source 400 into the display system 150 is slightly different from that depicted in FIG. 1 for a current sink 200. The current source 400 depicted in FIG. 4 is based on PMOS transistors. It should be understood that variations of this current source and its functioning are contemplated and include different types of transistors (PMOS, NMOS, or CMOS) and different semiconductor materials (e.g. LTPS, Metal Oxide, etc.).

The current source 400 includes a first switch transistor 402 (T4) controlled by an enable signal EN coupled to its gate terminal, and being coupled via one of a source and drain terminal of the first transistor switch 405 to a current bias line 423 (Ibias) corresponding to, for example, a current bias line 123*a* of FIG. 1. A gate terminal of a current drive transistor 406 (T1) is coupled to a first terminal of a storage capacitance 410, while a first of the source and drain terminals of the current drive transistor 406 is coupled to the other of the source and drain terminals of the first switch transistor 402, and a second of the source and drain terminals of the current drive transistor 406 is coupled to a second terminal of the storage capacitance 410. The second terminal of the storage capacitance 410 is coupled to VDD. A gate terminal of a second switch transistor 408 (T2) is coupled to a write signal line (WR), while one of its source and drain terminals is coupled to the first terminal of the storage capacitance 410 and the other of its source and drain terminals is coupled to the first of the source and drain terminals of the current driving transistor 406. A gate terminal of a third switch transistor 404 (T3) is coupled to a calibration control line (CAL), while one of its source and drain terminals is coupled to a voltage bias monitor line 460, corresponding, for example, to voltage bias or data lines 122*a*, 122*b* depicted in FIG. 1. The other of the source and drain terminals of the third switch transistor 404 is coupled to the first of the source and drain terminals of the current drive transistor 406.

In the embodiment depicted in FIG. 4, the current source is not coupled to a reference monitor line 160 such as that depicted in FIG. 1. Instead of the current source 400 being programmed with Vbias and a reference voltage as in the case of the current sink 200, the storage capacitance 410 of the current source 400 is programmed to a defined value using the voltage bias signal Vbias provided over the voltage bias or data line 122*a* and VDD. In this embodiment the data lines 122*a*, 122*b* serve as monitor lines as and when needed.

Referring once again to FIG. 3, an example of a timing of a current control cycle 300 for programming and calibrating the current source 400 depicted in FIG. 4 will now be described. The timing of the current control cycle 300 for programming the current source 400 of FIG. 4 is the same as that for the current sink 200 of FIG. 2.

The complete control cycle 300 occurs typically once per frame and includes four smaller cycles, a disconnect cycle 302, a programming cycle 304, a calibration cycle 306, and a settling cycle 308. During the disconnect cycle 302, the current source 400 ceases to provide biasing current Ibias to the current bias line 423 in response to the EN signal going high and the first transistor switch 402 turning off. By virtue of the CAL and WR signals being high, both the second and third switch transistors 408, 404 remain off. The duration of the disconnect cycle 402 also provides a settling time for the current source 400 circuit. The EN signal remains high throughout the entire control cycle 300, only going low once the current source 400 circuit has been programmed, calibrated, and settled and is ready to provide the bias current over the current bias line 423. Once the current source 400 has settled after the disconnect cycle 302 has completed, the programming cycle 304 begins with the WR signal going low turning on the second switch transistor 408 and with the CAL signal going low turning on the third switch transistor 404. During the programming cycle 304 therefore, the third switch transistor 404 and the second switch transistor 408 connects the voltage bias monitor line 460 over which there is transmitted a known Vbias signal to the first terminal of the storage capacitance 410. As a result, since the second terminal of the storage capacitance 410 is coupled top VDD, the storage capacitance 410 is charged to a defined value. This value is roughly that which is anticipated as necessary to control the current driving transistor 406 to deliver the appropriate current biasing Ibias taking into account optional calibration described below.

After the programming cycle 304 and during the calibration cycle 306, the circuit is reconfigured to discharge some of the voltage (charge) of the storage capacitance 410 though the current driving transistor 406. The calibration signal CAL goes high, turning off the third switch transistor 404 and disconnecting the first terminal of the storage capacitance 410 from the voltage bias monitor line 460. The amount discharged is a function of the main element of the current source 400, namely the current driving transistor 406 or its related components. For example, if the current driving transistor 406 is "strong", the discharge occurs relatively quickly and relatively more charge is discharged from the storage capacitance 410 through the current driving transistor 406 during the fixed duration of the calibration cycle 306. On the other hand, if the current driving transistor 406 is "weak," the discharge occurs relatively slowly and relatively less charge is discharged from the storage capacitance 410 through the current driving transistor 406 during the fixed duration of the calibration cycle 306. As a result the voltage (charge) stored in the storage capacitance 410 is reduced comparatively more for relatively strong current driving transistors versus comparatively less for relatively weak current driving transistors thereby providing some compensation for non-uniformity and variations in current driving transistors across the display whether due to variations in fabrication or degradation over time.

After the calibration cycle 306, a settling cycle 308 is performed prior to provision of the biasing current Ibias to the current bias line 423. During the settling cycle, the first and third switch transistors 402, 404 remain off while the WR signal goes high to also turn the second switch transistor 408 off. After completion of the duration of the settling cycle 308, the enable signal EN goes low turning on the first switch transistor 402 and allowing the current driving transistor 406 to source the Ibias current on the current bias line 423 according to the voltage (charge) stored in the storage capacitance 410, which as mentioned above, has a value which has been drained as a function of the current driving transistor 406 in order to provide compensation for the specific characteristics of the current driving transistor 406.

In some embodiments, the calibration cycle 306 is eliminated. In such a case, the compensation manifested as a change in the voltage (charge) stored by the storage capacitance 410 as a function of the characteristics of the current driving transistor 406 is not automatically provided. In such a case, as with the embodiment above in the context of a current sink 200 a form of manual compensation may be utilized in combination with monitoring for the current source 400.

In some embodiments, after a current source 400 has been programmed, and prior to providing the biasing current over the current bias line 423, the current of the current source 400 is measured through the voltage bias monitor line 460 by controlling the CAL signal to go low, turning on the third switch transistor 404.

Once the current of the current source 400 has been measured in response to known programming of the current source 400 and possibly after a number of various current measurements in response to various programming values have been measured and stored in memory 106, the controller 102 and memory 106 (possibly in cooperation with other components of the display system 150) adjusts the voltage Vbias used to program the current source 400 to compensate for the deviations from the expected or desired current sourcing exhibited by the current source 400. This monitoring and compensation, need not be performed every frame and can be performed in a periodic manner over the lifetime of the display to correct for degradation of the current source 400.

Although the current sink 200 of FIG. 2 and the current source 400 of FIG. 4 have each been depicted as possessing a single current driving transistor 206, 406 it should be understood that each may comprise a cascaded transistor structure for providing the same functionality as shown and described in association with FIG. 2 and FIG. 4.

While particular implementations and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of an invention as defined in the appended claims.

What is claimed is:

1. A system for providing biasing currents to pixels of an emissive display system, each pixel having a light-emitting device, the system comprising:

a plurality of current biasing elements external to said pixels;

a plurality of current bias lines coupling said plurality of current biasing elements to said pixels; and a controller coupled to said current biasing elements for controlling a programming of said current biasing elements over a plurality of signal lines;

wherein each current biasing element comprises:

at least one current driving transistor coupled to a current bias line for providing a biasing current over the current bias line; and a storage capacitance for being programmed and for setting a magnitude of the biasing current provided by the at least one current driving transistor;

wherein the controller's controlling the programming of each current biasing element comprises:

during a programming cycle charging the storage capacitance to a defined level; and subsequent to the programming cycle, during a calibration cycle, partially discharging the storage capacitance as a function of characteristics of the at least one driving transistor.

2. The system of claim 1, wherein the plurality of signal lines comprises a plurality of data lines coupling a source driver of the emissive display system to the pixels and for programming said pixels, the data lines for coupling the controller and the plurality of current biasing elements at times different from when the data lines couple the source driver to the pixels.

3. The system of claim 2, further comprising a reference monitor line shared by the plurality of current biasing elements and coupling the plurality of current biasing elements to the controller.

4. The system of claim 2 wherein each current biasing element is a current sink, wherein the at least one current driving transistor comprises a single current driving transistor, wherein the storage capacitance is coupled across a gate of said current driving transistor and one of a source and drain of said current driving transistor, the other of said source and drain of said current driving transistor coupled to a voltage supply, wherein during the calibration cycle, the current driving transistor is allowed to partially discharge said storage capacitance through the current driving transistor to said voltage supply.

5. The system of claim 2 wherein each current biasing element is a current source, wherein the at least one current driving transistor comprises a single current driving transistor, wherein the storage capacitance is coupled across a gate of said current driving transistor and one of a source and drain of said current driving transistor, the one of said source and drain of said current driving transistor coupled to a voltage supply, wherein during the calibration cycle, the current driving transistor is allowed to partially discharge said storage capacitance through the current driving transistor to said voltage supply.

6. A system for providing biasing currents to pixels of an emissive display system, each pixel having a light-emitting device, the system comprising:

a plurality of current biasing elements;

a plurality of current bias lines coupling said plurality of current biasing elements to said pixels;

a controller coupled to said current biasing elements for controlling a programming of said current biasing elements over a plurality of signal lines; and a monitor coupled to the plurality of current biasing elements for monitoring a biasing current produced by each current biasing element and for storing in a memory a measurement representing said biasing current for each current biasing element;

wherein each current biasing element comprises:

at least one current driving transistor coupled to a current bias line for providing a biasing current over the current bias line; and a storage capacitance for being programmed and for setting a magnitude of the biasing current provided by the at least one current driving transistor;

wherein the controller's controlling the programming of each current biasing element comprises:

retrieving from said memory said measurement representing said biasing current for the current biasing element;

determining a deviation of said biasing current represented by said measurement from an expected biasing current; and charging the storage capacitance to a defined compensated level which compensates for said deviation so that said current biasing element produces the expected biasing current.

7. The system of claim 6, wherein the plurality of signal lines comprises a plurality of data lines coupling a source driver of the emissive display system to the pixels and for programming said pixels, the data lines for coupling the controller and the plurality of current biasing elements at times different from when the data lines couple the source driver to the pixels.

8. The system of claim 6, further comprising a reference monitor line shared by the plurality of current biasing elements and coupling the plurality of current biasing elements to the controller, the controller coupled to the monitor.

9. A method of providing biasing currents to pixels of an emissive display system, each pixel having a light-emitting device, the emissive display system including a plurality of current biasing elements external to said pixels and a plurality of current bias lines coupling said plurality of current biasing elements to said pixels, each current biasing element including at least one current driving transistor coupled to a current bias line for providing a biasing current over the current bias line and a storage capacitance for being programmed and for setting a magnitude of the biasing current provided by the at least one current driving transistor, the method comprising:

programming each current biasing element over a plurality of signal lines comprising:

charging the storage capacitance to a defined level during a programming cycle; and subsequent to the programming cycle, during a calibration cycle, partially discharging the storage capacitance as a function of characteristics of the at least one driving transistor.

10. The method of claim 9, wherein the plurality of signal lines comprises a plurality of data lines coupling a source driver of the emissive display system to the pixels and for programming said pixels, the data lines for coupling the controller and the plurality of current biasing elements for performing said programming each current biasing element at times different from when the data lines couple the source driver to the pixels.

11. The method of claim 10, wherein a reference monitor line is shared by the plurality of current biasing elements and wherein said charging said storage capacitance comprises coupling to the controller over said reference monitor line each current biasing element being charged while de-coupling from the controller current biasing elements not being charged.

12. The method of claim 10 wherein each current biasing element is a current sink, wherein the at least one current driving transistor comprises a single current driving transistor, wherein the storage capacitance is coupled across a gate of said current driving transistor and one of a source and drain of said current driving transistor, the other of said source and drain of said current driving transistor coupled to a voltage supply, wherein during the calibration cycle, partially discharging the storage capacitance comprises allowing the current driving transistor to partially discharge said storage capacitance through the current driving transistor to said voltage supply.

13. The method of claim 10 wherein each current biasing element is a current source, wherein the at least one current driving transistor comprises a single current driving transistor, wherein the storage capacitance is coupled across a gate of said current driving transistor and one of a source and drain of said current driving transistor, the one of said source and drain of said current driving transistor coupled to a voltage supply, wherein during the calibration cycle, partially discharging the storage capacitance comprises allowing the current driving transistor to partially discharge said storage capacitance through the current driving transistor to said voltage supply.

14. A method of providing biasing currents to pixels of an emissive display system, each pixel having a light-emitting device, the emissive display system including a plurality of current biasing elements, a plurality of current bias lines coupling said plurality of current biasing elements to said pixels, each current biasing element including at least one current driving transistor coupled to a current bias line for providing a biasing current over the current bias line and a storage capacitance for being programmed and for setting a magnitude of the biasing current provided by the at least one current driving transistor, the method comprising:

monitoring a biasing current produced by each current biasing element;

storing in a memory a measurement representing said biasing current for each current biasing element; and programming each current biasing element over a plurality of signal lines comprising:

retrieving from said memory said measurement representing said biasing current for the current biasing element;

determining a deviation of said biasing current represented by said measurement from an expected biasing current; and charging the storage capacitance to a defined compensated level which compensates for said deviation so that said current biasing element produces the expected biasing current.

15. The method of claim 14, wherein the plurality of signal lines comprises a plurality of data lines coupling a source driver of the emissive display system to the pixels and for programming said pixels, the data lines for coupling the controller and the plurality of current biasing elements for performing said programming each current biasing element at times different from when the data lines couple the source driver to the pixels.

16. The method of claim 14, wherein the controller is coupled to the monitor, a reference monitor line is shared by the plurality of current biasing elements and wherein said monitoring each current biasing element comprises coupling to the controller over the reference monitor line each current biasing element being measured while de-coupling from the controller current biasing elements not being measured.

* * * * *